US010240316B2

(12) United States Patent
Dang

(10) Patent No.: US 10,240,316 B2
(45) **Date of Patent: *Mar. 26, 2019**

(54) LOCKING SUBGRADE VAULT

(71) Applicant: Oldcastle Precast, Inc., Auburn, WA (US)

(72) Inventor: Nguyen Thai Dang, Pomona, CA (US)

(73) Assignee: OLDCASTLE PRECAST, INC., Auburn, WA (US)

( * ) Notice: Subject to any disclaimer, the term of this patent is extended or adjusted under 35 U.S.C. 154(b) by 94 days.

This patent is subject to a terminal disclaimer.

(21) Appl. No.: 15/257,041

(22) Filed: Sep. 6, 2016

(65) Prior Publication Data

US 2016/0369474 A1 Dec. 22, 2016

Related U.S. Application Data

(63) Continuation-in-part of application No. 14/081,829, filed on Nov. 15, 2013, now Pat. No. 9,435,099.

(60) Provisional application No. 61/727,279, filed on Nov. 16, 2012.

(51) Int. Cl.

| | |
|---|---|
| ***E02D 29/14*** | (2006.01) |
| ***E05C 9/10*** | (2006.01) |
| ***E05B 65/00*** | (2006.01) |
| ***B65D 88/76*** | (2006.01) |
| ***B65D 90/10*** | (2006.01) |

(52) U.S. Cl.

CPC ..... *E02D 29/1427* (2013.01); *B65D 88/76* (2013.01); *B65D 90/105* (2013.01); *E05B 65/006* (2013.01); *E05C 9/10* (2013.01)

(58) Field of Classification Search

CPC .. B65F 1/1447; E05B 65/006; E02D 29/1427; E02D 29/14

See application file for complete search history.

(56) References Cited

U.S. PATENT DOCUMENTS

| | | | | |
|---|---|---|---|---|
| 1,349,465 | A | 9/1886 | Stevens | |
| 2,055,166 | A | 9/1936 | Berry | |
| 2,114,499 | A * | 4/1938 | MacLear | E02D 29/1427 49/465 |
| 2,291,290 | A | 7/1942 | Tinnerman | |
| 2,342,312 | A | 2/1944 | Tinnerman | |
| 2,355,486 | A | 8/1944 | Tinnerman | |
| 2,364,668 | A | 12/1944 | Simmons | |
| 2,385,927 | A | 10/1945 | Mason | |

(Continued)

FOREIGN PATENT DOCUMENTS

| | | |
|---|---|---|
| DE | 3144890 | 5/1983 |
| DE | 29813074 | 11/1998 |

(Continued)

OTHER PUBLICATIONS

U.S. Appl. No. 29/618,330, Freeman et al.

(Continued)

*Primary Examiner* — Shawn M Braden

(74) *Attorney, Agent, or Firm* — Sheridan Ross PC

(57) ABSTRACT

A subgrade vault system with a locking lid assembly is provided. Specifically, a subgrade vault suitable for housing utility and similar equipment is provided, the vault comprising a main body portion, a cap, and a lid that may be selectively secured with one or more rotatable locking mechanisms to prevent or deter unauthorized access to vault contents.

20 Claims, 18 Drawing Sheets

(56) References Cited

U.S. PATENT DOCUMENTS 2,396,835 A 3/1946 Eggert
2,401,671 A 6/1946 Thomas et al.
2,403,566 A 7/1946 Thorp et al.
2,404,672 A 7/1946 Volf
2,410,968 A 11/1946 Eggert
2,410,988 A 11/1946 Mevi
2,434,844 A 1/1948 Flora
2,552,499 A 5/1951 Tinnerman
2,682,211 A 6/1954 Avila
2,693,100 A 11/1954 Weigel
2,727,552 A 12/1955 Chivosta
2,931,383 A 4/1960 Handley
3,029,964 A 4/1962 Hudson et al.
3,039,666 A 6/1962 Carpenter, Sr.
3,318,476 A 5/1967 Clark
3,385,012 A 5/1968 Lovegreen
3,530,696 A 9/1970 Dunmire
3,727,438 A 4/1973 Knaack
3,760,234 A 9/1973 Jones et al.
3,858,614 A 1/1975 Moore et al.
D237,285 S 10/1975 Helenurm
3,911,635 A 10/1975 Traupe
3,920,347 A 11/1975 Sauriol et al.
3,921,494 A * 11/1975 Coe ..... F16B 21/10 292/192
3,972,440 A 8/1976 Warren
3,974,599 A 8/1976 Grosh
D244,173 S 5/1977 Thurman
4,059,199 A 11/1977 Quaney
4,074,491 A 2/1978 Bell et al.
4,163,503 A 8/1979 McKinnon
4,204,419 A 5/1980 Cale
4,266,380 A 5/1981 Samolis
4,461,597 A 7/1984 Laurin
D279,952 S 8/1985 Daenen et al.
4,567,697 A 2/1986 Hahne
D289,582 S 5/1987 Brush, Jr. et al.
4,844,518 A 7/1989 Pritchard
D302,491 S 8/1989 Brush, Jr. et al.
4,863,059 A 9/1989 Christensen
4,863,327 A 9/1989 Poupiter
4,867,600 A 9/1989 Bowman
4,919,578 A 4/1990 Zeigler et al.
4,948,181 A 8/1990 Pritchard
4,973,191 A 11/1990 Dannhauser
4,976,568 A 12/1990 Hess
5,123,776 A 6/1992 Lang et al.
5,134,758 A 8/1992 Christensen
5,152,651 A 10/1992 Artéon
5,197,307 A 3/1993 Abbott, Jr.
5,205,668 A 4/1993 Adams
D335,378 S 5/1993 Mariol
5,324,135 A 6/1994 Smith
5,375,940 A 12/1994 Kobayashi
D355,118 S 2/1995 Dickinson et al.
D357,161 S 4/1995 Booten
D361,511 S 8/1995 Dickinson et al.
5,462,383 A 10/1995 Van 'T Veer
5,484,076 A 1/1996 Petrushka
D367,211 S 2/1996 Cautereels
5,549,411 A 8/1996 Hawkins
D373,953 S 9/1996 Gale
D376,693 S 12/1996 Wolff
5,605,353 A 2/1997 Moss et al.
D379,138 S 5/1997 Carlson
5,627,340 A 5/1997 Smith et al.
5,647,729 A 7/1997 de Jong et al.
D382,112 S 8/1997 Egan
D385,673 S 10/1997 Siler et al.
5,697,729 A * 12/1997 Bowman ..... E02D 29/1427 404/25
D394,550 S 5/1998 Tanji
5,782,584 A 7/1998 Arthur
5,829,215 A 11/1998 Billing
5,975,323 A 11/1999 Turan
5,987,824 A 11/1999 Fuller
D417,361 S 12/1999 Mittmann et al.
6,000,576 A 12/1999 Liu
6,007,270 A 12/1999 Bowman
D426,064 S 6/2000 Douglas et al.
6,087,582 A 7/2000 Arthur
6,321,928 B1 11/2001 Goldenstein et al.
6,371,687 B1 4/2002 Heintz et al.
6,371,688 B1 4/2002 Yang et al.
D469,607 S 2/2003 Wolff
D474,596 S 5/2003 Osiecki et al.
6,688,806 B2 2/2004 Kuan
6,752,565 B2 6/2004 Schrage
6,764,261 B1 7/2004 Stadler
6,772,566 B1 8/2004 Machledt et al.
6,811,119 B1 11/2004 Petersen et al.
6,820,760 B2 11/2004 Wegner et al.
6,899,240 B2 5/2005 Dang et al.
6,932,099 B2 8/2005 Mahaney
D510,802 S 10/2005 Sagol
6,953,209 B2 * 10/2005 Jackson, Jr. ..... E05B 17/0025 16/412
6,992,252 B1 1/2006 Rao et al.
7,009,513 B2 3/2006 Dang
7,030,315 B1 4/2006 Dunn et al.
7,128,495 B1 10/2006 Lill et al.
D531,802 S 11/2006 Zimmerman
7,163,352 B2 1/2007 Jurich et al.
7,201,533 B2 4/2007 DeGreef
D547,175 S 7/2007 Berg
D569,073 S 5/2008 Osiecki et al.
D570,074 S 5/2008 Osiecki et al.
D571,524 S 6/2008 Kang et al.
7,385,137 B2 6/2008 Burke et al.
D574,125 S 7/2008 Gunst et al.
D579,625 S 10/2008 Kang et al.
7,467,910 B2 12/2008 Lecuyer et al.
7,484,908 B2 2/2009 Stadler
7,500,412 B1 3/2009 Maciejewski
7,501,573 B2 3/2009 Balfour, Jr.
D590,709 S 4/2009 Fitzsimmons
D598,197 S 8/2009 Ahlstrom
7,607,553 B2 10/2009 Weber
D606,306 S 12/2009 Monte
7,683,256 B1 3/2010 Chumacero
7,748,926 B2 7/2010 Jurich et al.
D622,061 S 8/2010 Higginson
D624,275 S 9/2010 Min
7,807,923 B2 10/2010 Moran
7,855,338 B2 12/2010 Troder
7,891,904 B2 2/2011 Stadler
D639,065 S 6/2011 Duvigneau
D640,138 S 6/2011 Lee
8,013,244 B1 9/2011 Chumacero
D648,538 S 11/2011 Reinhart et al.
8,061,928 B2 11/2011 Jurich et al.
D654,693 S 2/2012 Freeman
8,113,740 B2 2/2012 Boulton et al.
8,156,773 B1 4/2012 Olson et al.
D662,323 S 6/2012 Jurich et al.
8,242,386 B1 8/2012 Baldwin et al.
8,272,528 B2 9/2012 Dunn
8,302,796 B1 11/2012 Johnson
D682,553 S 5/2013 Jurich et al.
8,469,628 B2 6/2013 Miller et al.
D693,535 S 11/2013 Henderson et al.
D696,526 S 12/2013 Christensen
8,821,062 B2 9/2014 Miller et al.
8,835,757 B2 9/2014 Freeman
8,921,712 B1 12/2014 Gretz
8,944,266 B2 2/2015 Roemer et al.
D730,015 S 5/2015 Osiecki et al.
9,021,842 B2 5/2015 Rix
D731,739 S 6/2015 Hine et al.
D732,264 S 6/2015 Hine et al.
D732,265 S 6/2015 Osiecki et al.
9,054,509 B2 6/2015 Knapp
9,174,798 B2 11/2015 Freeman
9,435,099 B2 9/2016 Dang

(56) References Cited

U.S. PATENT DOCUMENTS

| | | | | |
|---|---|---|---|---|
| D772,522 | S | 11/2016 | Henderson et al. | |
| D799,149 | S | 10/2017 | Chafetz | |
| D800,989 | S | 10/2017 | Lucido | |
| D803,508 | S | 11/2017 | Horn et al. | |
| D811,687 | S | 2/2018 | Kang | |
| D817,589 | S | 5/2018 | Culbreth | |
| 2004/0042849 | A1 | 3/2004 | Jurich et al. | |
| 2004/0244444 | A1 | 12/2004 | Wadsworth | |
| 2006/0088378 | A1 | 4/2006 | Pendleton et al. | |
| 2007/0194493 | A1 | 8/2007 | Jurich et al. | |
| 2008/0048460 | A1* | 2/2008 | Brady | E02D 29/124 292/256.71 |
| 2008/0169392 | A1 | 7/2008 | McClure et al. | |
| 2008/0310931 | A1 | 12/2008 | Cisik et al. | |
| 2009/0087279 | A1 | 4/2009 | McGinn et al. | |
| 2009/0226260 | A1 | 9/2009 | Boulton et al. | |
| 2010/0040433 | A1 | 2/2010 | Poppe et al. | |
| 2010/0296865 | A1 | 11/2010 | Jurich et al. | |
| 2010/0310338 | A1 | 12/2010 | Diez Herrera | |
| 2010/0329782 | A1 | 12/2010 | Miller et al. | |
| 2011/0203334 | A1 | 8/2011 | Rix | |
| 2011/0290802 | A1 | 12/2011 | Burros | |
| 2012/0073106 | A1 | 3/2012 | Jurich et al. | |
| 2012/0228302 | A1 | 9/2012 | Byrns | |
| 2013/0205674 | A1 | 8/2013 | Damon | |
| 2013/0263425 | A1 | 10/2013 | Miller et al. | |
| 2016/0046440 | A1 | 2/2016 | Freeman | |
| 2017/0166368 | A1 | 6/2017 | Freeman | |

FOREIGN PATENT DOCUMENTS

| | | |
|---|---|---|
| EP | 0390767 | 10/1990 |
| EP | 0529178 | 3/1993 |
| EP | 1004709 | 5/2000 |
| FR | 2760765 | 9/1998 |
| FR | 2890671 | 3/2007 |
| GB | 2175630 | 12/1986 |
| GB | 2207164 | 1/1989 |
| GB | 2276405 | 9/1994 |
| GB | 2378971 | 2/2003 |
| GB | 2390629 | 1/2004 |
| WO | WO 98/53151 | 11/1998 |

OTHER PUBLICATIONS

Notice of Allowance for U.S. Appl. No. 14/925,561, dated Nov. 15, 2017 7 pages.
Notice of Allowance for U.S. Appl. No. 15/446,400, dated Nov. 21, 2017 9 pages.
"Copper Theft Epidemic Inspires the Jensen MetalTech Design of Tamper Resistant Locking Lids to Secure Utility Enclosures Such As Pull Boxes and Handholes," Jensen Precast, Feb. 2012, 3 pages.
"MR Steel Security Lid," Karish Industries, last modified Apr. 2014, 1 page.
"MR Steel Security Pull Box Lid," Karish Industries, last modified Apr. 2015, 2 pages.
"NewBasis drop-N-lock PC Lids," photo taken Sep. 2016, 2 pages.
"Vandal Resistant Pull Box Insert," McCain Inc. © 2012, 2 pages.
"B09TL Cast Iron Lid with Lock," Oldcastle Precast, Inc., Jun. 18, 2008, 1 page.
"13 x 24 Series Box & Cover," cdr Systems Corp., 1996, 1 page.
"1324 Grade Ring, HDPE, Green," Oldcastle Precast, Inc., 2008, 2 pages.
"1324-12 BODY Fibrelyte 2x Floating Nut Provision," Oldcastle Precast, Inc., 2010, 5 pages.
17 x 30 Flared Wall Series, Box, Cover & Extension, cdr Systems Corp., 2002, 1 page.
17 x 30 Straight Wall Series, Box & Cover, cdr Systems Corp., 2002, 1 page.
"6-inch Standard Extension," Oldcastle Precast, Inc., 2009, 1 page.
"BODY, 1730-24, HDPE, Green, Split-Cover Prov.," Carson Industries LLC (now Oldcastle Precast), 2004, 1 page.
"Caltrans Revised Standard Plans," California Department of Transportation, 2004, Part 1, 34 pages.
"Caltrans Revised Standard Plans," California Department of Transportation, 2004, Part 2, 35 pages100 pages.
"Caltrans Revised Standard Plans," California Department of Transportation, 2004, Part 3, 31 pages.
"Concrete Products Catalog," Oldcastle Precast, Inc., 2009, 90 pages.
"Concrete Products, Inc. Catalog," Christy Concrete Products (now Oldcastle Precast, Inc.), 1999, 5 pages.
"Dry Utilities Polymer and Plastic Products Catalog," Oldcastle Precast, Inc., 2003, Part I, 63 pages.
"Dry Utilities Polymer and Plastic Products Catalog," Oldcastle Precast, Inc., 2003, Part II, 73 pages.
"Dry Utilities Polymer and Plastic Products Catalog," Oldcastle Precast, Inc., 2009, Part I, 79 pages.
"Dry Utilities Polymer and Plastic Products Catalog," Oldcastle Precast, Inc., 2009, Part II, 81 pages.
"Enclosure Solutions for Fiber & Copper Cable," Oldcastle Precast, 2009, 8 pages.
"F12 Fiberlyte," Christy Concrete, 2003, 1 page.
"SA32-1324-24 Box & Cover Assembly," cdr Systems Corp, 1991, 1 page.
"Secondary Enclosures for Electric Underground," PG&E, 2009, 15 pages.
Specifications for Commercial Construction, Roseville Electric, 2000, 3 pages.
"Super Jumbo XL," Oldcastle Precast, Inc., 2009, 2 pages.
"Super Jumbo," Oldcastle Precast, Inc., 2009, 2 pages.
"Syn1730D Polymer Concrete Lid," Oldcastle Precast, Inc., 2008, 1 page.
"Telephone Electric CATV," Pencell Plastics, Inc., 2007, 4 pages.
"Underground Enclosures and Pads," Quazite, Hubbell Lenoir City, Inc., 2009, 107 pages.
Utility Infrastructure Price List, Carson Industries LLC, 2005, 18 pages.
Manning et al., "Tourist's Death on Strip Worries County," Las Vega Sun, 2003, 2 pages.
Stephens, "Handholes and Underground Electrical Enclosures," NEC Digest, Strongwell Corp., 2005, 10 pages.
Final Action for U.S. Appl. No. 14/925,561, dated Dec. 23, 2016, 10 pages.
Notice of Allowance for U.S. Appl. No. 14/925,561, dated Jun. 1, 2017, 7 pages.
Official Action for U.S. Appl. No. 15/446,400, dated May 19, 2017 11 pages.
Official Action for U.S. Appl. No. 29/618,330, dated Jun. 15, 2018, 8 pages. Restriction Requirement.
Official Action for U.S. Appl. No. 14/971,646, dated Apr. 5, 2018, 7 pages.
"Complaint with Jury Demand," filed Aug. 1, 2014 (Case 2:14-cv-01815-WBS-EFB), 61 pages.
"Grade Ring with Installation Kit," Oldcastle Precast, 2008, 2 pages.
"Underground Enclosure with Fastener," date unknown, 2 pages.
"Western Underground Committee Guide 3.6," Western Underground, date unknown, 14 pages.
Applicant's Admitted Prior Art: Eisel Enterprises Inc. Precast Concrete Products, date unknown, 21 pages.
Applicant's Admitted Prior Art: US Concrete Precast Group Products, date unknown, 9 pages.
Brooks Products Meter Boxes and Pull Boxes, drawing revision date Dec. 6, 2000, 17 pages.
Brooks Products Meter Boxes and Pull Boxes, drawing revision date Jan. 9, 2001, 4 pages.
Trade Dress U.S. Appl. No. 85/272,635, filed Mar. 21, 2011; Reg. No. 4,204,420, issued Sep. 11, 2012, 2 pages.
Trade Dress U.S. Appl. No. 85/272,629, filed Mar. 21, 2011; Reg. No. 4,204,419, issued Sep. 11, 2012, 2 pages.
Official Action for U.S. Appl. No. 13/294,054, dated Feb. 27, 2014 11 pages.
Notice of Allowance for U.S. Appl. No. 13/294,054, dated Jun. 23, 2014 7 pages.

(56) References Cited

OTHER PUBLICATIONS

Official Action for U.S. Appl. No. 14/486,662, dated Mar. 27, 2015 7 pages.
Notice of Allowance for U.S. Appl. No. 14/486,662, dated Jul. 8, 2015, 9 pages.
Official Action for U.S. Appl. No. 14/486,662, dated Mar. 14, 2016 14 pages.
Official Action for U.S. Appl. No. 14/081,829, dated Jan. 13, 2015 6 pages Restriction Requirement.
Official Action for U.S. Appl. No. 14/081,829, dated Apr. 24, 2015 13 pages.
Official Action for U.S. Appl. No. 14/081,829, dated Oct. 7, 2015 14 pages.
Notice of Allowance for U.S. Appl. No. 14/081,829, dated May 5, 2016 5 pages.
Notice of Allowance for Design U.S. Appl. No. 29/386,380, dated Feb. 29, 2012, 9 pages.
Official Action for Design U.S. Appl. No. 29/424,306, dated Sep. 13, 2012, 7 pages.
Notice of Allowance for Design U.S. Appl. No. 29/424,306, dated Jan. 7, 2013, 5 pages.
Notice of Allowance for Design U.S. Appl. No. 29/378,870, dated Nov. 4, 2011, 9 pages.

* cited by examiner

LOCKING SUBGRADE VAULT

This U.S. Non-Provisional patent application is a Continuation-in-Part Application which claims the benefit of priority from U.S. patent application Ser. No. 14/081,829, filed Nov. 15, 2013, and claims the benefit of priority from U.S. Provisional Patent Application No. 61/727,279, filed Nov. 16, 2012, the entire disclosures of which are hereby incorporated by reference in their entireties.

FIELD OF THE INVENTION

The present disclosure relates generally to vaults for providing an enclosed region beneath a ground surface. More specifically, vaults are provided comprising a locking lid with a cap assembly for securing various electrical, water, communications and other components and systems below grade of ground level.

BACKGROUND OF THE INVENTION

Subgrade vaults are widely used to provide internal enclosed regions where connections can be made and housed. Classic examples of such connections are the joinder of electrical cables used in street lighting, in telephone and communication systems, and water valves for residential communities and golf courses. Such vaults are generally placed below grade of ground level with their upper surfaces at grade where loads from pedestrians and vehicles, as well as environmental factors such as the presence of precipitation and animals are anticipated. Generally, the vaults will be used by and allow access to municipalities, utility companies, and other installations where longevity of the vaults, and affordability are important. Although subgrade vaults are typically comprised of precast or poured-in-place concrete, alternative materials such as fiberglass, plastic, and other materials may be used and the present invention is not limited to any given material.

Vault systems and devices are intended for access and interaction with trained professionals who, for example, need to service complex, dangerous, and/or valuable subgrade systems to maintain vital infrastructure. Accordingly, in addition for these devices and systems to withstand various forces and abuse due to environmental conditions, it is desirable to provide systems that allow for general ease of access to the appropriate individuals, while simultaneously preventing unauthorized access. A lid for providing access to an enclosed subgrade region must not only be structurally sound, but must be simple to remove and replace, while reliably holding the lid onto the body when access is not needed.

Subgrade storage systems generally contain and/or provide access to valuable components necessary in performing critical functions and/or with respect to monetary value. In part due to the high commodity prices of metals and other internal components, theft is an increasing problem which is not only expensive but extremely disruptive when communication, electrical or water service is discontinued. Furthermore, improperly secured or physically damaged subgrade systems may present hazardous conditions to passer-bys and professionals alike. Currently known systems fail to provide adequate safety and security measures for preventing and/or deterring unauthorized access to subgrade storage areas.

SUMMARY OF THE INVENTION

There has thus been a long-felt but unmet need to provide a subgrade vault system having features adapted for securing at least a lid portion to additional system components, such as a vault cap. The following references relate to the field of subgrade storage vaults and facilities and are hereby incorporated by reference in their entireties: U.S. Pat. No. 4,567,697 to Hahne, U.S. Pat. No. 6,772,566 to Machledt et al., U.S. Pat. No. 6,899,240 to Dang et al., U.S. Pat. No. 7,163,352 to Jurich et al., U.S. Pat. No. 7,385,137 to Burke et al., U.S. Pat. No. 7,467,910 to Lecuyer et al., and U.S. Pat. No. 7,748,926 to Jurich et al. Co-owned and co-pending U.S. patent application Ser. No. 13/294,054, filed Nov. 10, 2011 is also hereby incorporated by reference in its entirety.

It is one object of the present invention to provide for an improved subgrade or above grade vault system having locking or selectively securing features to prevent unwanted access to an enclosed region. It is another object of the present invention to provide a concrete enclosure adapted for containing subgrade systems wherein the concrete enclosure comprises a lid which can be secured when the lid is generally in a closed or sealed position, thus preventing unwanted or unauthorized access to contents of the enclosure.

It is another object of this invention to provide an improved subgrade vault, with cost effective manufactured components to selectively secure an enclosure. In various embodiments, the present invention comprises a cap adapted to be connected or secured to a concrete box or structure for containing, enclosing, and/or securing subgrade utility components. In one embodiment, the present invention comprises a plastic cap formed to or connected with a quantity of concrete, the concrete having a height extending downwardly from the plastic cap, a generally polygonal or rectangular shape, and a predetermined thickness. In one embodiment, the quantity of concrete comprises a top portion to which a cap is formed or attached and a bottom portion that is generally open. In an alternative embodiment, the present invention comprises a quantity of concrete comprising four side walls and a bottom portion, such that the device comprises a fully contained enclosure when a lid, as will be described in further detail, is placed on or connected to a top portion.

In various embodiments, precast concrete is used to form portions of a subgrade storage vault, as precast concrete is generally known to provide a substance that is simultaneously rigid and strong enough to accommodate various compressive and shear loading that a subgrade vault is likely to experience. However, it is to be expressly understood that the present invention is not limited to embodiments comprising precast concrete. Indeed, any rigid material determined to be economically feasible for use in subgrade storage vaults may be used to form the body and/or peripheral walls of a lockable subgrade storage vault in accordance with the present invention. For example, in various embodiments, a lockable subgrade vault structure is provided wherein various components comprise cellular concrete, polyethylene, polypropylene, polyvinyl chloride, nylon, polycarbonate, aluminum, acrylonitrile butadiene styrene, acetal, acrylic, epoxy, fluorocarbons, lonomer, polybutylene, polyester, polystyrene, silicone, various combinations thereof and various similar materials thereto.

In various embodiments, the present invention comprises a subgrade storage facility wherein a molded plastic cap is first formed and a main body comprising four walls is formed or extruded therefrom. In a particular embodiment, the present invention comprises an injection molded, roto-molded or blow-molded plastic cap and a main body portion comprises precast concrete and a method of making the same. In one embodiment, the present invention comprises an injection molded cap adapted for receiving a locking device, wherein at least a portion of the locking device is secured to the cap and/or body upon extrusion or creation of the body portion from the cap. For example, a cap may be provided comprising four sides, each of said four sides having a width approximately corresponding to a width of a sidewall of a main body portion to be extruded or extended therefrom.

In various embodiments, lids for covering and securing a vault area provided. The lids comprise one or more adjustable members, the adjustable members adapted for being selectively positioned in at least two positions where a first position corresponds to an unlocked state and a second position corresponds to a locked or secured state. For example, in one embodiment, at least one substantially rigid member is provided on a bottom or under-side of the lid. The substantially rigid member is rotatably secured to the lid by, for example, at least one hinge. Rotation of the substantially rigid member about the at least one hinge transitions the member between a locked position and an unlocked position. The locked position is generally characterized by a rotational or angular position of the member wherein the member contacts a portion of the vault and substantially limits or prohibits movement of the lid in at least one direction (e.g. the vertical direction). The unlocked position is generally characterized by a rotational or angular position of the member wherein the member does not contact the vault and thus does not inhibit movement of the lid at least in one direction. In certain embodiments, a corresponding vault is provided in combination with the lid, the vault comprising preferred internal dimensions to operatively interact with features of the lid. For example, in one embodiment, internal side walls of the vault comprise a sloped or tapered arrangement such that provision of the substantially rigid member(s) in a first position results in contact and/or an interference fit between the member(s) and side wall(s) such that the lid may not be removed. Similarly, provision of the member in a second position results in the absence of such contact or fit and renders the lid capable of lifted vertically and removed.

While various embodiments of the present disclosure contemplate tapered internal surfaces of a vault or storage area, alternative arrangements are also contemplated. For example, in one embodiment, a recession is provided on at least one internal surface of a vault corresponding to at least one substantially rigid member, the recession provided to receive at least a portion of the substantially rigid member and prevent movement of the lid. Alternatively, a projection may be provided on an internal surface of the vault to perform substantially the same function as the recession. Projections and recessions may be provided along only a portion of a perimeter of the vault or may extend around the entire perimeter or circumference.

In various embodiments, the position (e.g. the angular position) of the at least one substantially rigid member is adjustable from above (i.e. the top side) of the lid. Adjustment features including, for example, threaded members are provided through the lid. At least a portion of the adjustment member is accessible from a surface level or top portion of the lid to adjust enclosed or subgrade members.

In various embodiments, a locking member is provided comprising one or more apertures for accessing one or more locking features. For example, in one embodiment, a locking member comprises a substantially rigid member hinged at one end and a threaded member located distal from the hinge. The threaded member is rotatable about an axis and useful for rotating the substantially rigid member about the hinge.

In one embodiment, a locking member comprises two substantially rigid members each hinged and rotatable about two points. The embodiment comprises a single centralized adjustment member comprising a threaded member and translatable features.

It is to be expressly understood that various locking members may achieve objects of the present invention and, as such, the present invention contemplates numerous variations of the locking members as shown and described herein. These variations, as will be recognized by one of ordinary skill in the art include, but are not limited to variations within size, shape, orientation, material, and quantity of locking members that are provided. It will also be expressly understood that various embodiments of locking members as described herein may be provided either in isolation or in combination with various other contemplated locking members or features.

Locking members of the present invention may be comprised of any material known to provide sufficient strength properties and combinations thereof. Accordingly, although a preferred embodiment contemplates a metal locking mechanism disposed within a concrete main body portion and a plastic cap, the present invention is not limited to any such embodiment.

In various embodiments, the present invention comprises a lid adapted to be secured to a cap and vault structure. In one embodiment, a lid of the present invention comprises a combination of plastic and a concrete material, wherein an outer portion of the lid is generally comprised of plastic to accommodate stress concentrations at specific locations and generally prevent or reduce the risk of chipping and cracking at corner and perimeter regions of the lid. An inner or central portion is generally comprised of a concrete material, such as Portland cement or precast concrete adapted for accommodating anticipated static and dynamic loading known to be experienced by a subgrade vault with a lid.

In one embodiment, a lid of the present disclosure comprises at least one aperture or through-hole and an optional cap, lid, or cover, for selectively sealing the same. The aperture or through-hole is formed such that a rotatable member is received herein, the aperture providing a point of access for the rotatable member and actuating system components shown and described herein. Accordingly, when a lid is placed on or within a cap of the present invention, an enclosed vault region is established, with access to a locking member(s) provided through an aperture formed in the lid. Thus, when a lid is placed upon a subgrade vault, the lid may be further secured and/or locked to additional components via one or more fasteners. For example, in one embodiment, once a lid is placed upon a cap, one or more apertures formed in the cap provide above-grade access for a threaded fastener such as a bolt to be secured to a female threaded portion. In various embodiments, cap or cover features are provided to cover or conceal apertures and locking hardware formed in a lid, thus providing a generally flush lid surface for improving aesthetic and safety characteristics of the lid.

In various embodiments, unauthorized access to an internal volume of a subgrade vault is prevented or at least minimized through the use of tamper-proof fasteners. For example, lids of the present invention may be secured to caps, vaults, and/or additional components through the use of one or more tamper-proof fasteners. One of skill in the art will recognize that a wide variety of known or custom-made tamper-proof fasteners may be employed in embodiments of the present invention, such that an ordinary passerby or potential pillager is unlikely to possess the requisite tool for removing/loosening the fastener. By way of example only, tamper-proof fasteners suitable for use in the present invention include, but are not limited to those available through Tamperproof Screw Company, Inc.

In one embodiment, the present invention comprises a subgrade vault having a lid with a single aperture formed in a corner of the lid and corresponding to a locking member formed in a cap/vault portion for securing the lid to the vault. In an alternative embodiment, the present invention comprises a lid having a plurality of apertures in a plurality of corners of the lid, each of the apertures corresponding to a subgrade locking mechanism for securing the lid to the cap/vault.

In various embodiments, the present invention comprises a lid with one or more apertures and corresponding subgrade locking mechanism(s) disposed in a central region of the lid and vault opening. For example, in a particular embodiment, the present invention comprises a lid with an aperture disposed in a central region of the lid and a locking mechanism spanning across a dimension of the cap and providing a point of attachment for the lid within a central region of the lid, or alternatively on one or more edges of the cap.

In various embodiments, the present invention comprises one or more apertures having removable features for selectively viewing or accessing a subgrade feature, such as a meter. For example, in one embodiment, a lid is provided having a removable feature adapted for being selectively removed from a remainder of the lid such that subgrade features, such as a water meter, may be read without the need for complete removal of the lid. In various embodiments, the removable feature or features comprise pry-off lids or caps adapted to be removed and applied with relative ease to observe or read one or more subgrade features. In alternative embodiments, caps or lids for observing subgrade features comprise securing features, such as tamper-proof fasteners as previously described.

In various embodiments, subgrade vault lids are provided having one more plates or portions adapted to display information. For example, in one embodiment, a composite plastic and concrete cover is provided having a plastic name plate for displaying general information related to the contents of the vault (e.g. "ELECTRICAL," "WATER," "GAS," etc.)

In one embodiment, a method of forming a subgrade concrete vault is provided comprising: (1) placing a locking member on the underside of a pre-formed plastic cap by aligning pre-formed plastic pins of said plastic cap through the corresponding holes provided in the locking element and applying a force to the locking element; (2) placing the plastic cap and locking member into a precast mold or on a vibrating table with a jig to align the cap with mold; (3) optionally inserting a sizing ring into the plastic cap; (4) pouring a concrete into a mold, wherein at least one boundary of the mold is defined by the cap; (5) verifying that the plastic cap and locking element have not been damaged; (6) placing the product into a kiln and curing the product; (7) removing the product from the kiln and verifying that it is ready to be shipped and/or sold. After forming, a concrete vault is provided with an integral plastic cap which includes a bracket embedded in the concrete vault and which is adapted to receive hardware such as a bolt which secures the lid to the cap and requires a special tool.

In one embodiment, a method of securing a lid to a subgrade concrete vault structure is provided, the method comprising: (1) placing a lid on a cap portion of a subgrade vault; (2) verifying that an aperture of the lid is generally aligned with a threaded aperture of a locking mechanism attached to a the subgrade vault; (3) where an aperture of the lid is not generally aligned with a threaded aperture of a locking mechanism, removing the lid, adjusting the location of the threaded aperture of the locking mechanism, and replacing the lid; (4) inserting and applying torque to a tamper-proof fastener until the fastener secures the lid to the vault via contact between a portion of the fastener with a portion of the lid and threaded attachment to the threaded aperture in the locking mechanism.

In various embodiments, a subgrade vault for providing an enclosed region to house utility connections is provided, the vault comprising a body portion having four side walls which define an enclosure, each of the four side walls having a predetermined thickness, an upper end, and lower end, and a perimeter of the upper end being less than a perimeter of the lower end; a cap member interconnected to the upper end of at least one of the four side walls; and a lid for closing the upper end, the lid comprising a top surface and a bottom surface and the bottom surface comprising at least one substantially rigid locking feature rotatable between a first position and a second position.

In one embodiment, a lid for a subgrade vault providing an enclosed region to house utility connections is provided, the lid comprising an upper surface and a lower surface, and a predetermined length, width, and height; locking means for releasably securing the lid to the vault, the locking means comprising at least rotatable member provided on the lower surface of the lid; the at least one rotatable member having a predetermined length and rotatable between at least a first unlocked position and a second locked position, the second locked position characterized by a distal end of the at least one rotatable member being in force transmitting communication with an interior surface of said vault.

In certain embodiments, a locking lid is provided comprising a selectively rotatable locking element, the locking element being disposed substantially below-grade but being accessible and/or rotatable from a top surface area of the lid. The locking element comprises a downwardly extending shaft portion which extends substantially perpendicularly to a top and bottom surface of the lid. The downwardly extending shaft portion comprises an extension, the extension extending substantially perpendicularly to the shaft portion and substantially parallel to the top and bottom surfaces of the lid. A proximal portion of the shaft is provided proximal the upper surface of the lid, and the locking element is rotatable by applying a rotational force to the proximal portion. The extension may be rotated into force-transmitting contact with anyone of the four side walls of the vault. It is further contemplated that indicia may be provided on the proximal portion and/or the lid, for example, to indicate whether a rotational position of the proximal portion corresponds to a locked or unlocked position of the locking element; a locked position characterized in that the extension is in force-transmitting contact with a sidewall and prevents removal of the lid and an unlocked position characterized in that the extension is not in contact with a side and lifting or removal of the lid is not impacted by the locking element.

In one embodiment, a shaft portion comprising an extension also comprises a biasing feature. For example, in one embodiment, a proximal head of the shaft portion comprises a coil spring that biases the shaft portion and associated extension upwardly. To rotate the shaft portion and move the locking element between a locked and unlocked position, a user may push and turn the proximal end of the shaft, thereby compressing the spring and enabling rotation. The proximal head may comprise a bolt head or similar device, such as those which accept a flathead or Phillips head screwdriver.

Caps of the present disclosure generally comprise a plastic material or fiberglass and the main body portion comprises a concrete material. Vaults of the present disclosure generally comprise an open center portion which is bounded by four sidewalls of the main body portion and is generally open at a top and bottom. In various embodiments, a main body portion is formed of concrete by placing a plastic cap in a generally up-side down position and pouring a quantity of concrete onto the cap via a mold or guide. The cap is sealed to the concrete with numerous projections which extend into the concrete. Thus, in various embodiments, the wall thickness of a main body portion of the present invention is approximately equal to a cap width as shown and described.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. Further details and other features will become apparent after review of the following Detailed Description and accompanying drawing figures.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
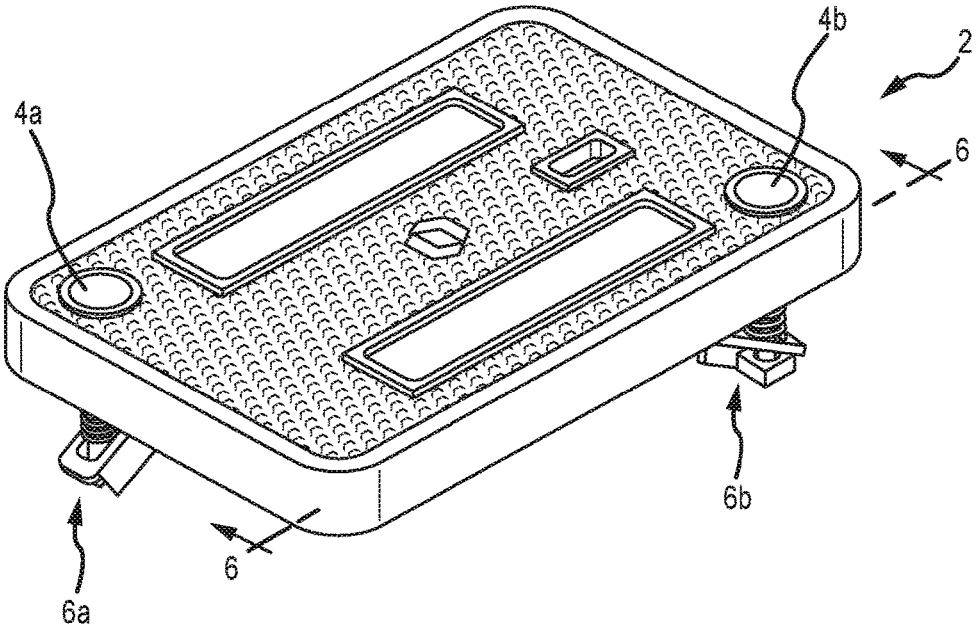
Figure 2:
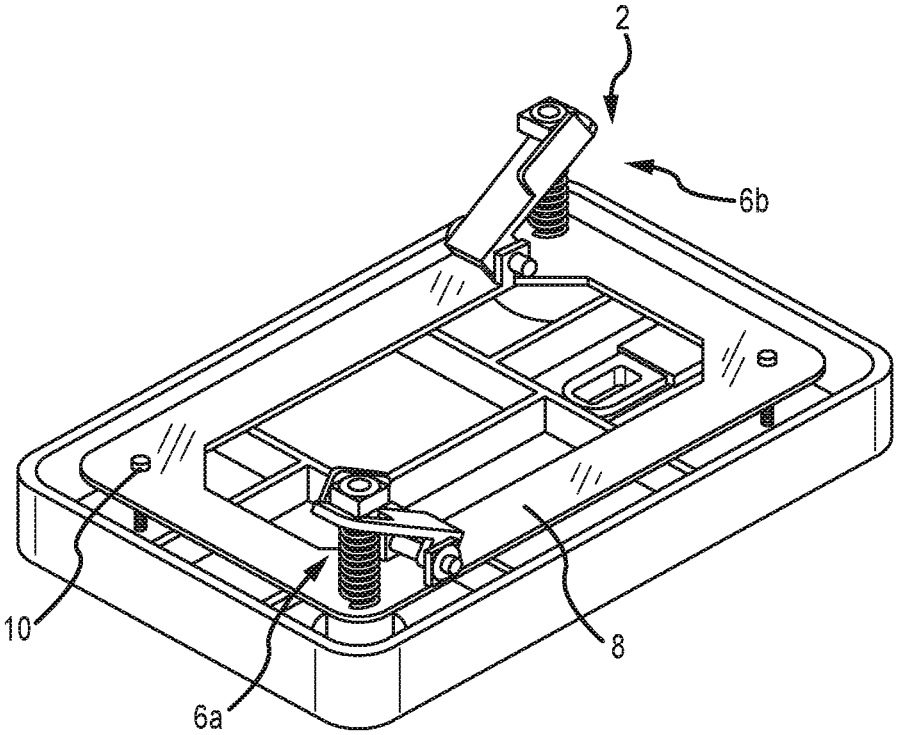
Figure 3A:
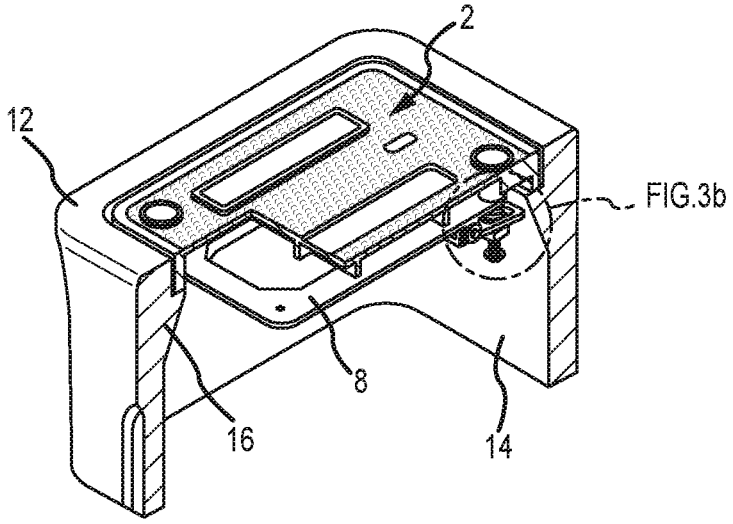
Figure 3B:
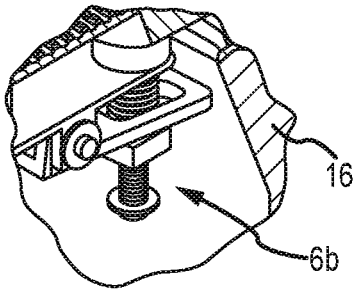
Figure 4A:
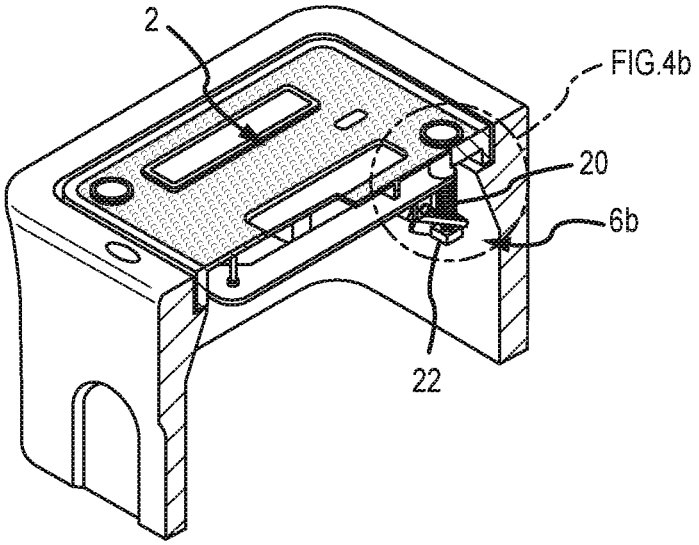
Figure 4B:
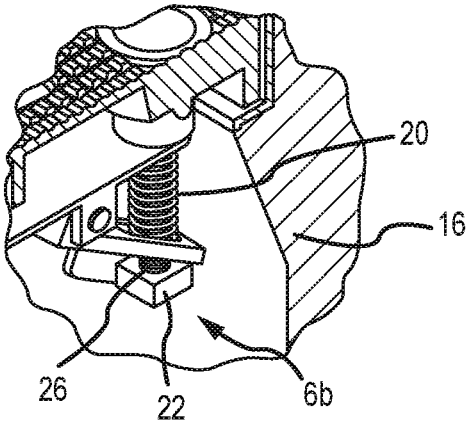
Figure 5A:
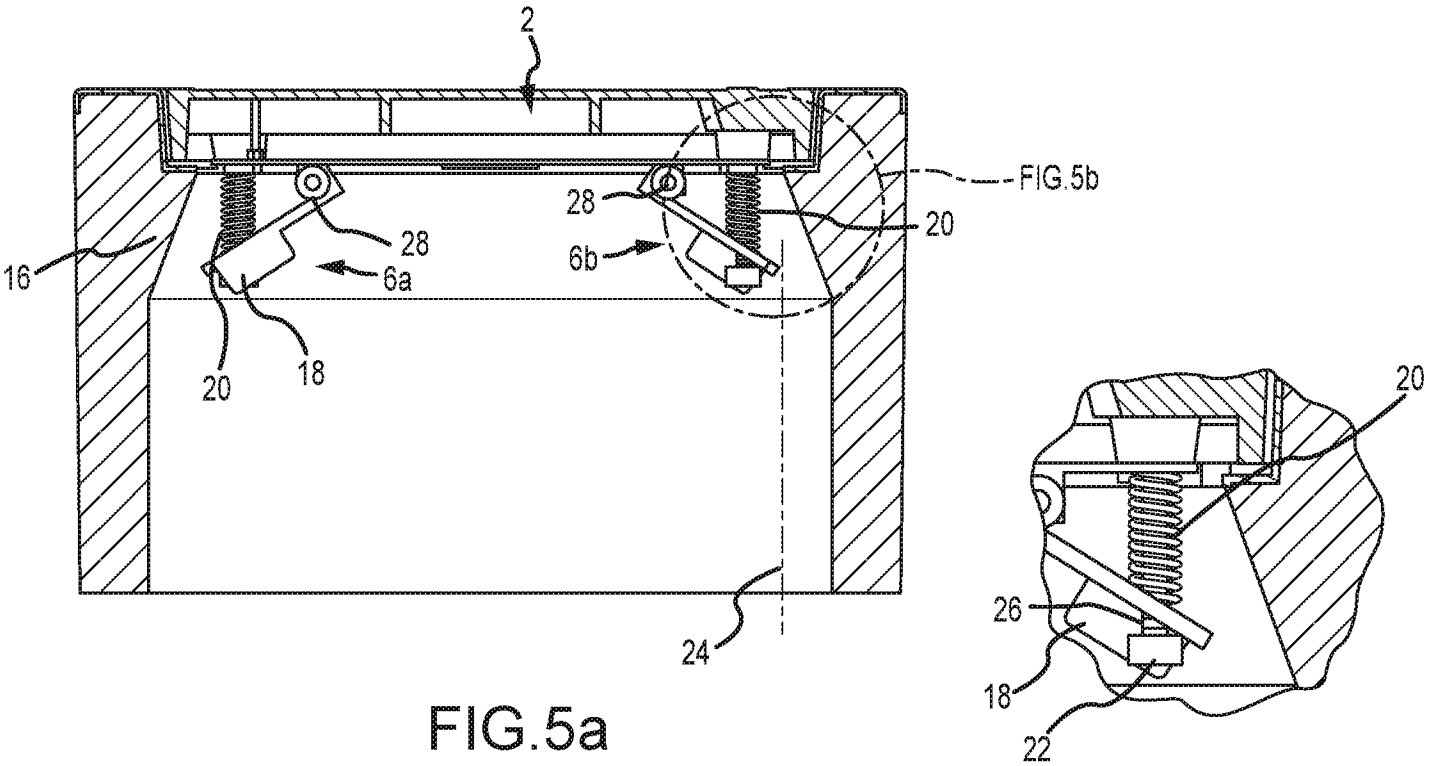
Figure 6:
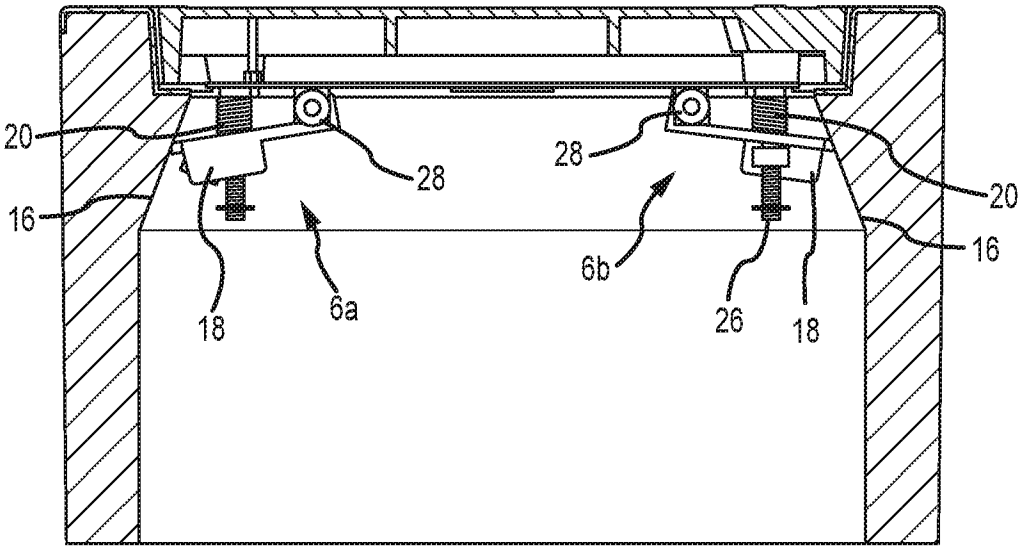
Figure 7:
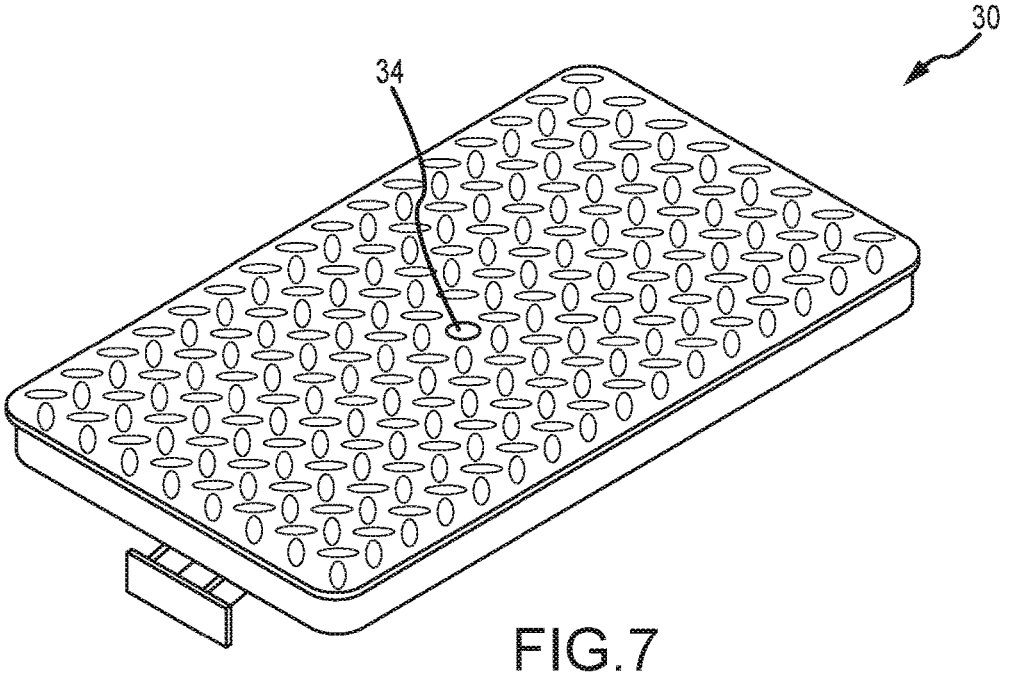
Figure 8:
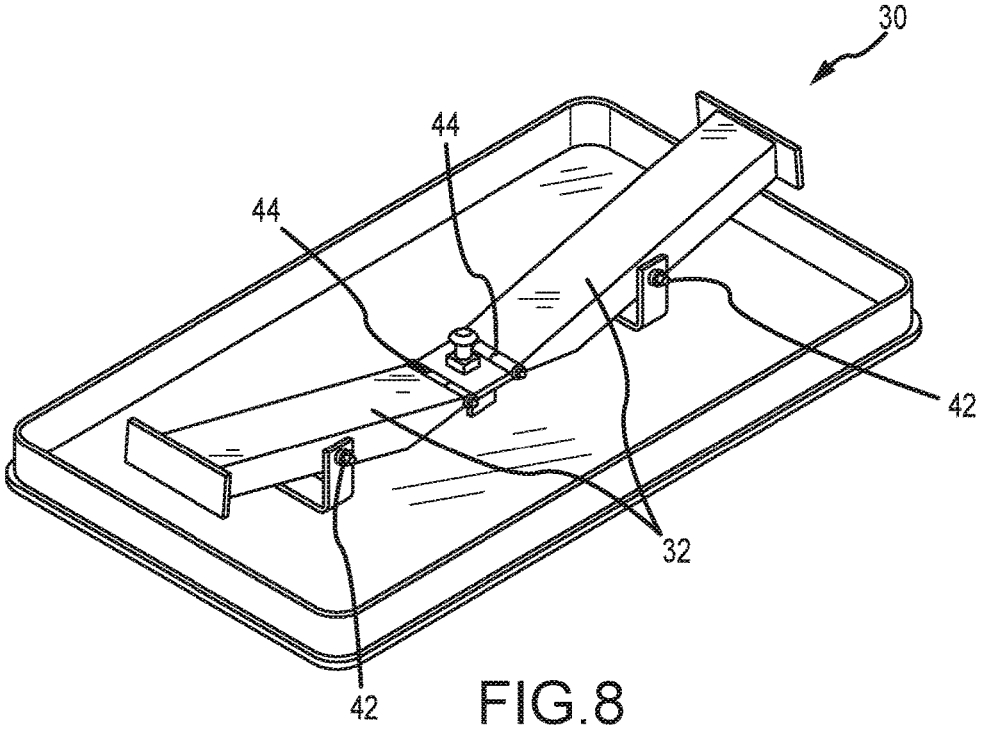
Figure 9A:
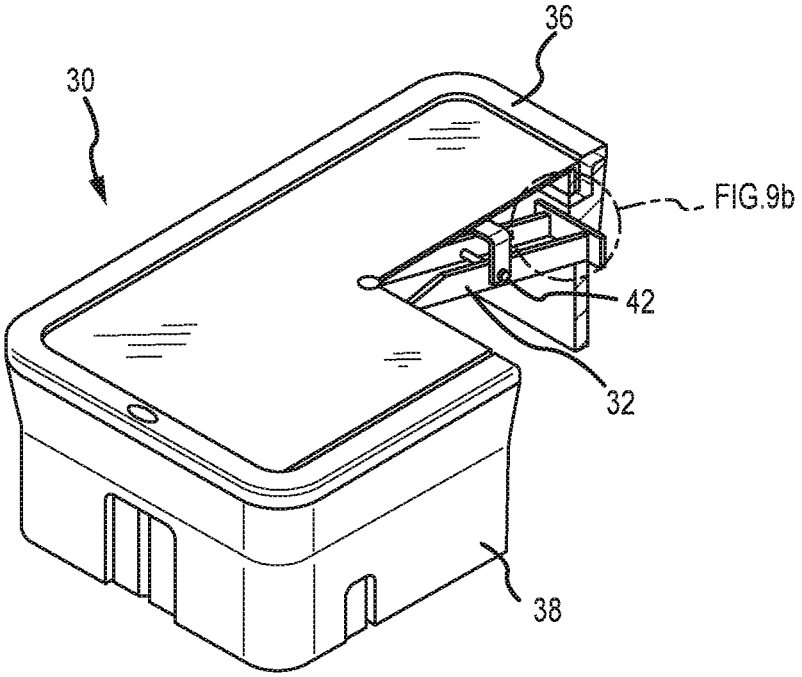
Figure 9B:
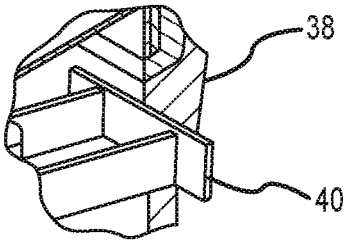
Figure 10A:
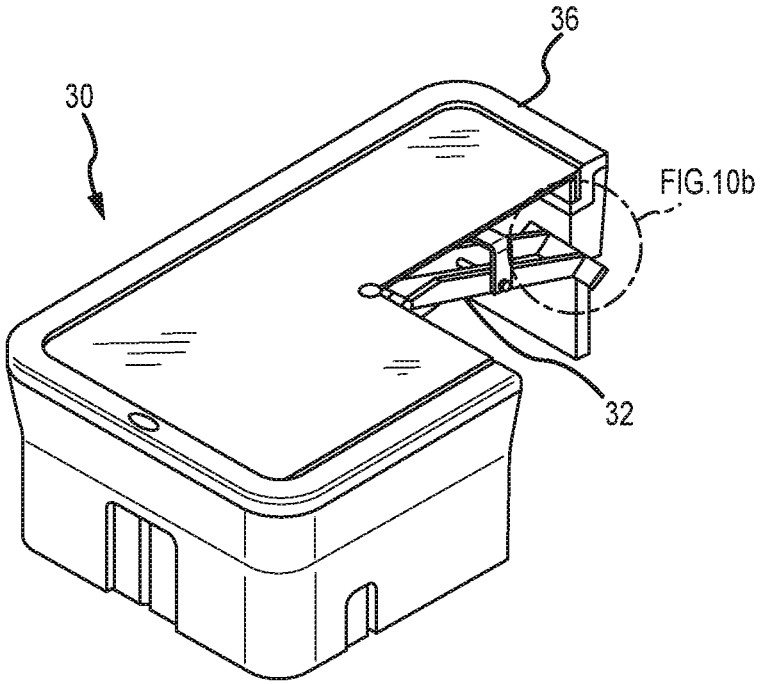
Figure 10B:
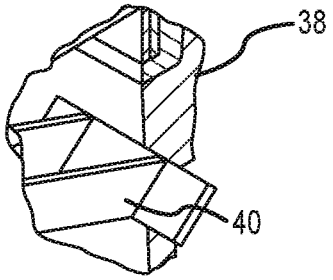
Figure 11A:
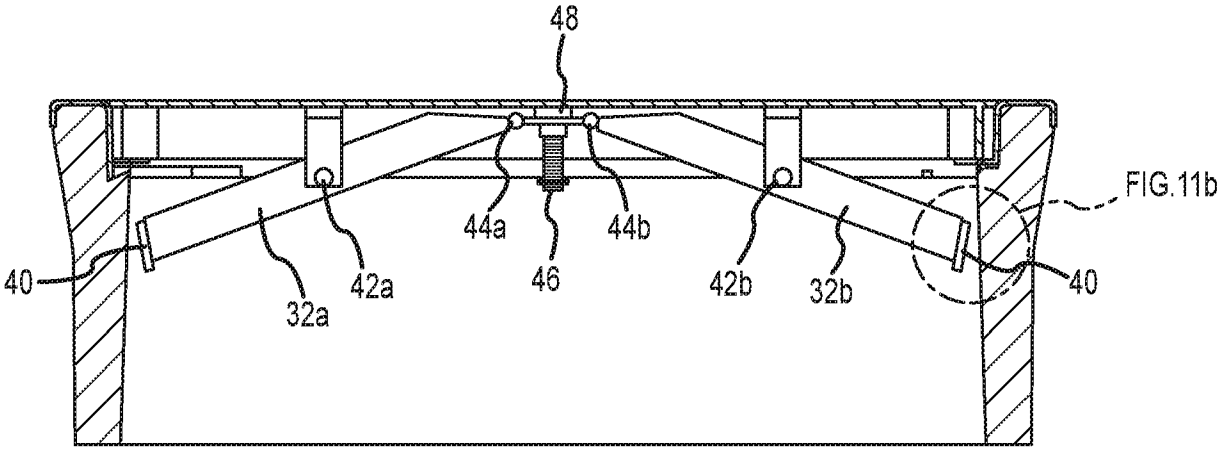
Figure 11B:
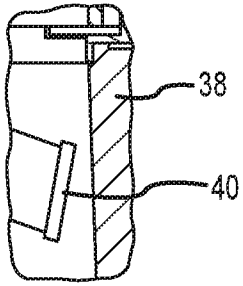
Figure 12:
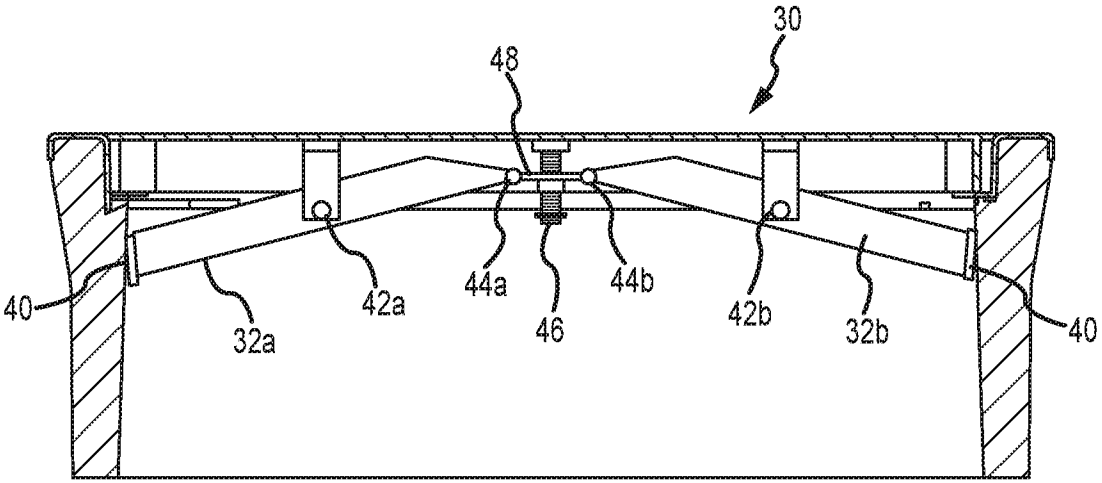
Figure 13B:
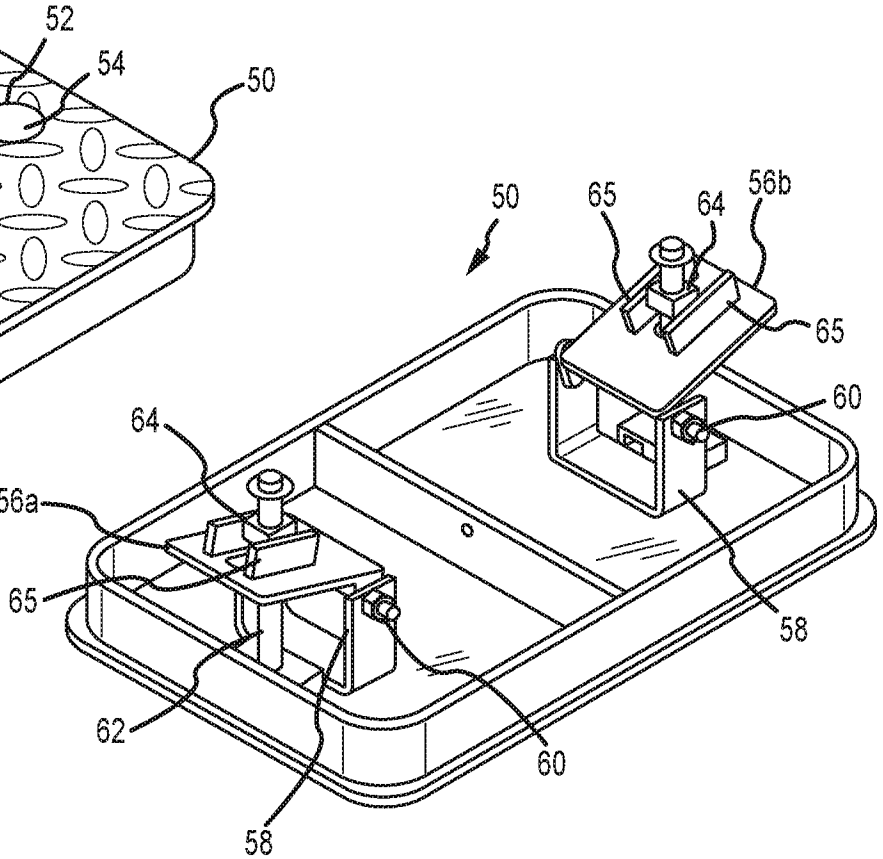
Figure 13A:
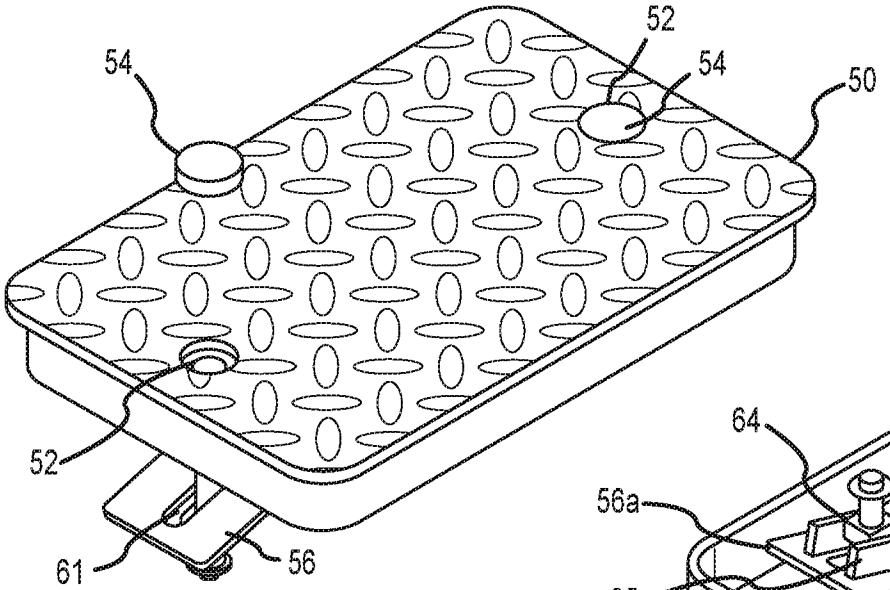

FIG. 1 is a top perspective view of a locking lid according to one embodiment of the present disclosure;

FIG. 2 is a bottom perspective view of the locking lid of FIG. 1;

FIG. 3*a* is a partially exploded top perspective view of the locking lid of FIG. 1;

FIG. 3*b* is a detailed top perspective view of the locking lid of FIG. 1;

FIG. 4*a* is a partially exploded top perspective view of the locking lid according the embodiment of FIG. 1;

FIG. 4*b* is a detailed top perspective view of the locking lid according to the embodiment of FIG. 1;

FIG. 5*a* is a cross-sectional front view of the embodiment of FIG. 1;

FIG. 5*b* is a detailed front elevation view of the embodiment of FIG. 1;

FIG. 6 is a cross-sectional front view of the embodiment of FIG. 1 taken at line 6-6 and depicting a subgrade vault and cap;

FIG. 7 is a top perspective view of a locking lid according to an alternative embodiment of the present disclosure;

FIG. 8 is a bottom perspective view of the locking lid of FIG. 7;

FIG. 9*a* is a partially exploded top perspective view of the locking lid according to the embodiment of FIG. 7;

FIG. 9*b* is a detailed top perspective view of the locking lid according to the embodiment of FIG. 7;

FIG. 10*a* is a partially exploded top perspective view of the locking lid according to the embodiment of FIG. 7;

FIG. 10*b* is a detailed top perspective view of the locking lid according to the embodiment of FIG. 7;

FIG. 11*a* is a cross-sectional front view of the embodiment of FIG. 7 with a cap attached to a subgrade vault;

FIG. 11*b* is a detailed front elevation view of the embodiment of FIG. 7;

FIG. 12 is a cross-sectional front view of the embodiment of FIG. 7;

FIG. 13*a* is top perspective view of a lid according to an alternative embodiment;

FIG. 13*b* is a bottom perspective view of the embodiment shown in FIG. 13*a;*

Figure 14C:
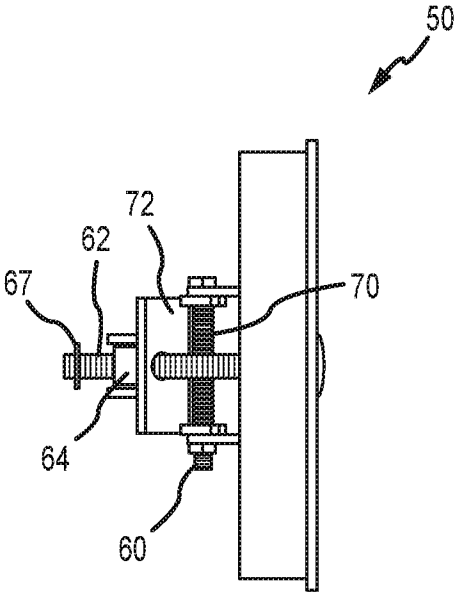
Figure 14A:
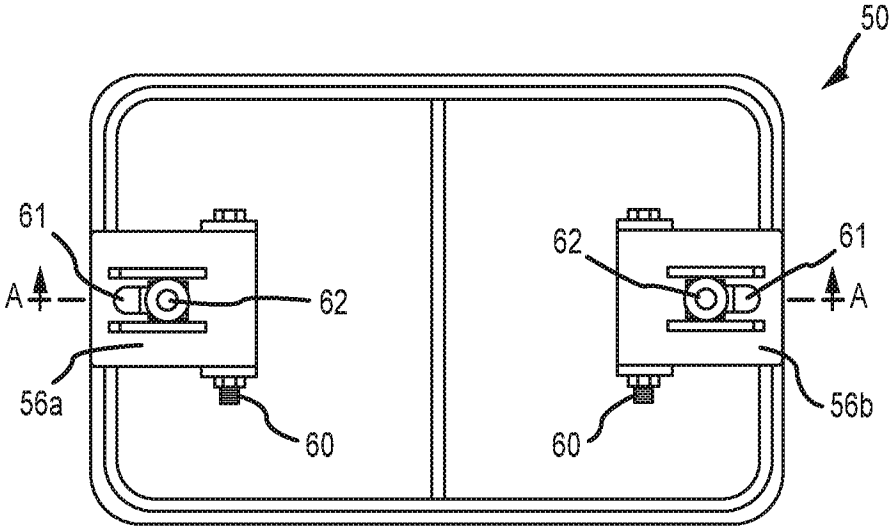

FIG. 14*a* is a bottom plan view of a lid according to the embodiment of FIG. 13*a;*

Figure 14B:
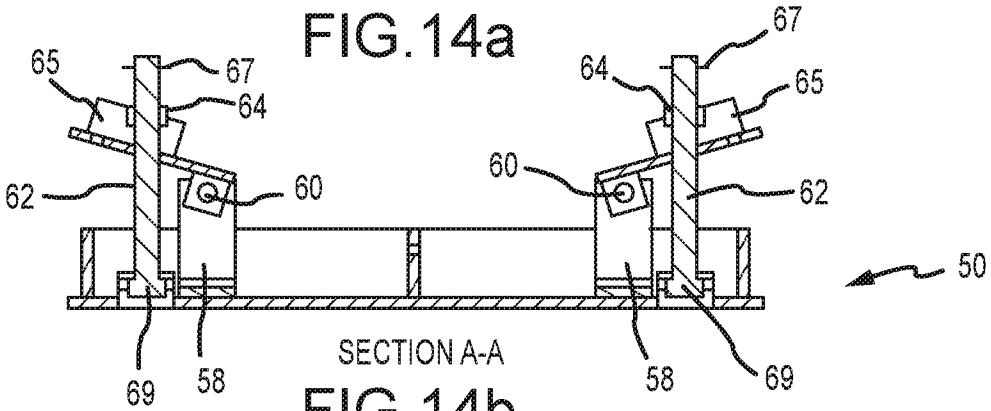

FIG. 14*b* is an elevation view of a lid according to the embodiment of FIG. 13*a;*

FIG. 14*c* is a side elevation view of a lid according to the embodiment of FIG. 13*a;*

Figure 15A:
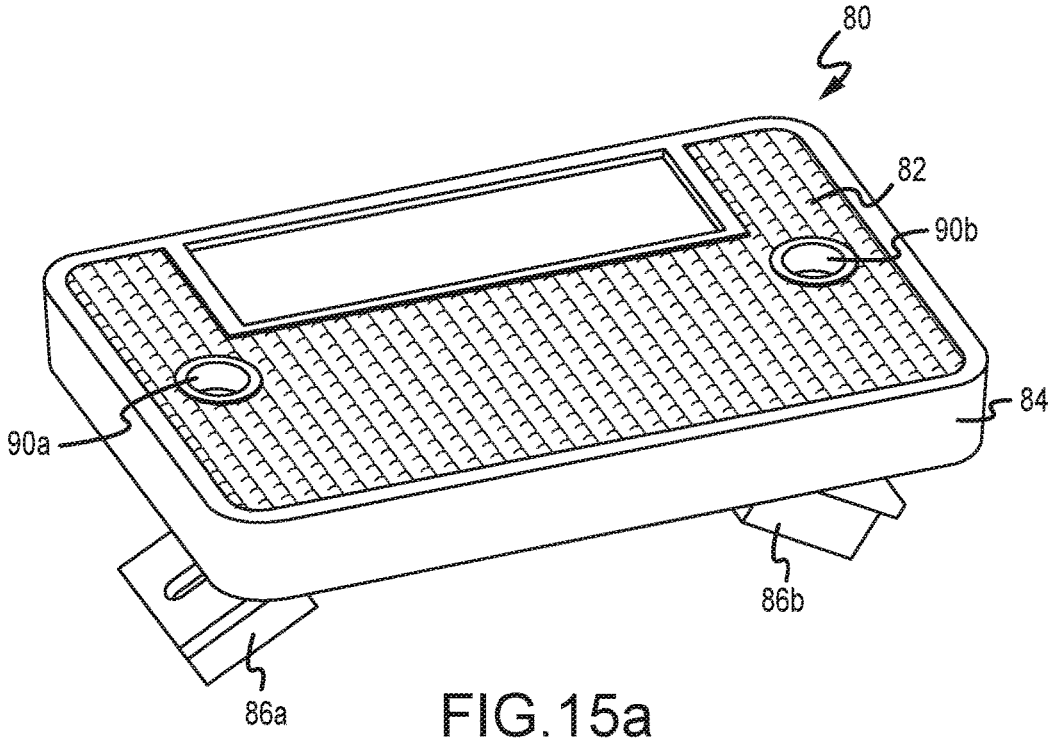
Figure 15B:
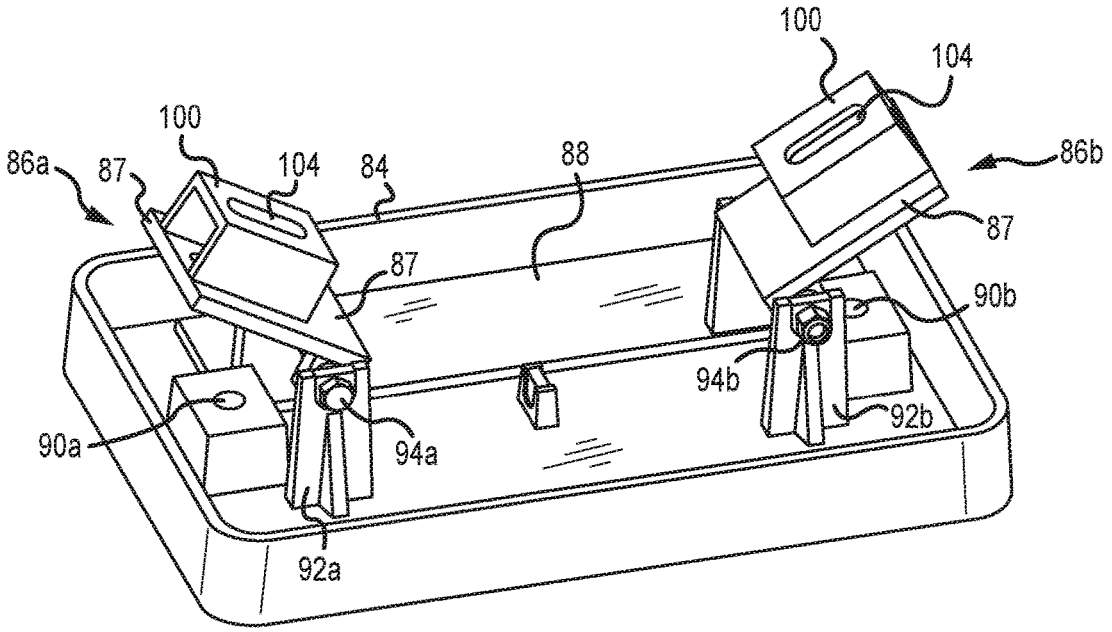

FIG. 15*a* is a top perspective view of a locking lid according to one embodiment of the present disclosure;

FIG. 15*b* is a bottom perspective view of the locking lid of the embodiment of FIG. 15*a;*

Figure 16:
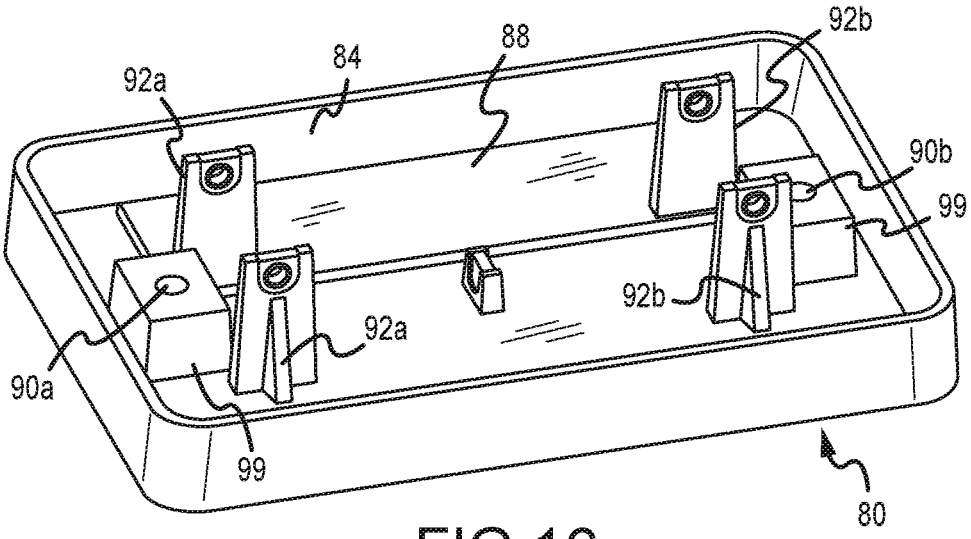

FIG. 16 is a bottom perspective view of the locking lid of the embodiment of FIG. 15*a;*

Figure 17:
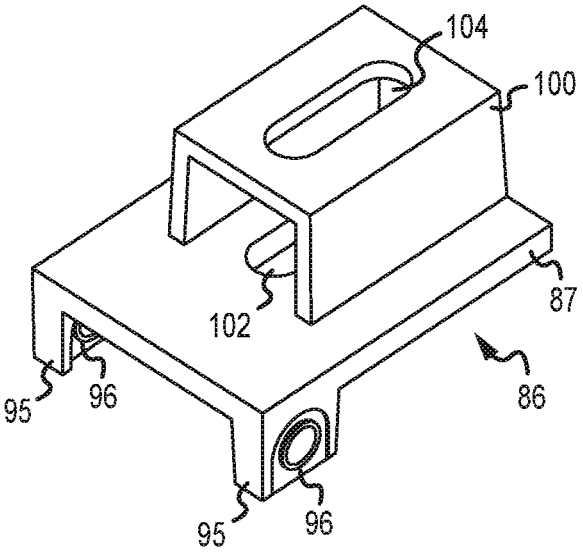

FIG. 17 is a perspective view of a component of the locking lid according to the embodiment of FIG. 15*a;*

Figure 18:
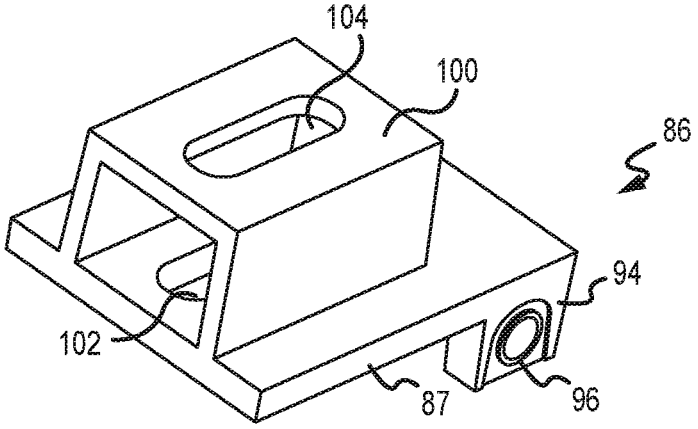

FIG. 18 is a perspective view of a component of the locking lid according to the embodiment of FIG. 15*a;*

Figure 19:
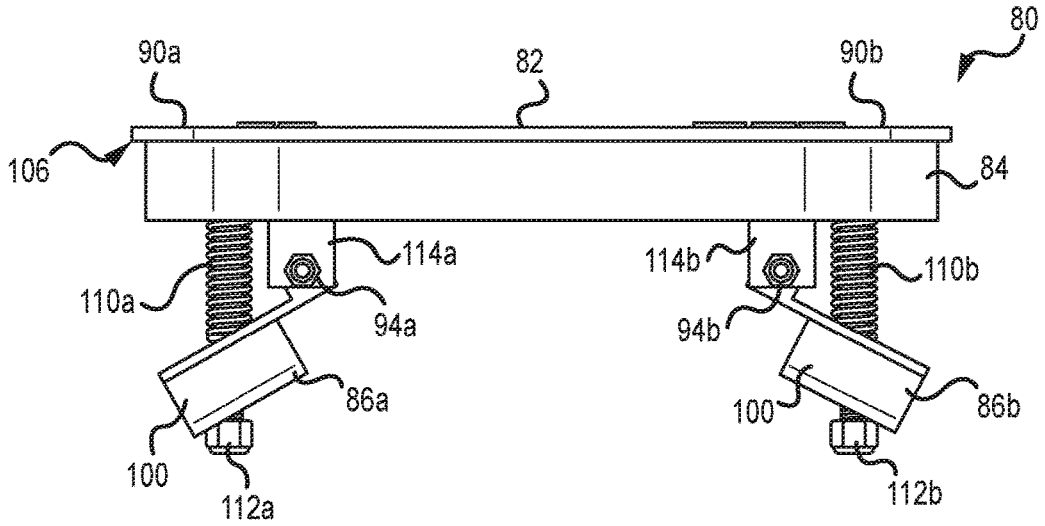
Figure 20:
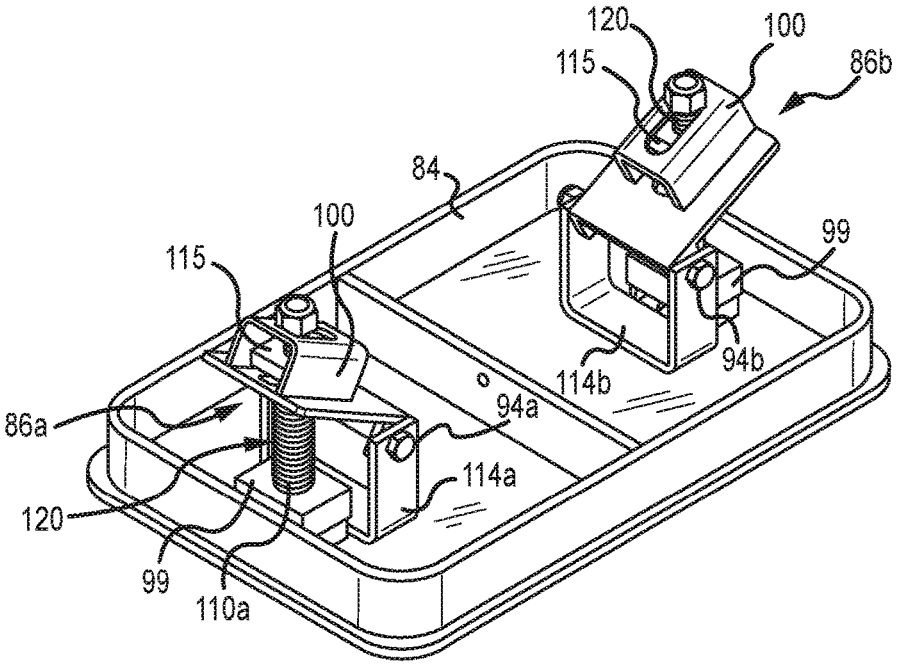
Figure 21A:
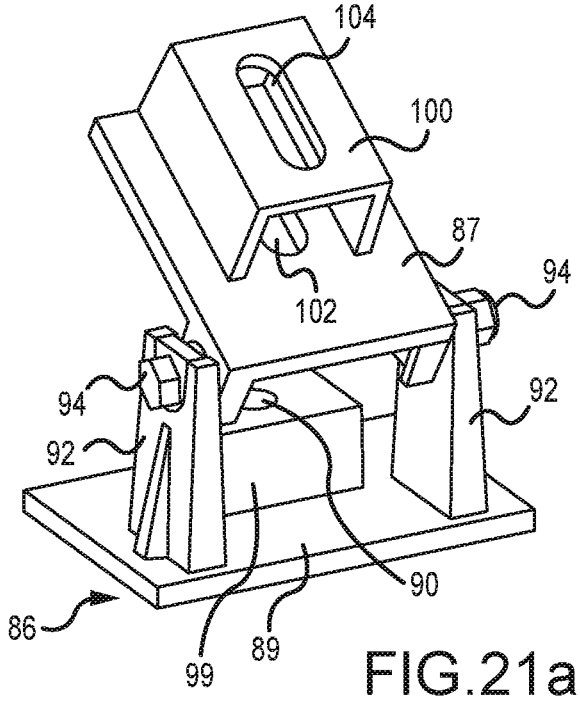
Figure 21B:
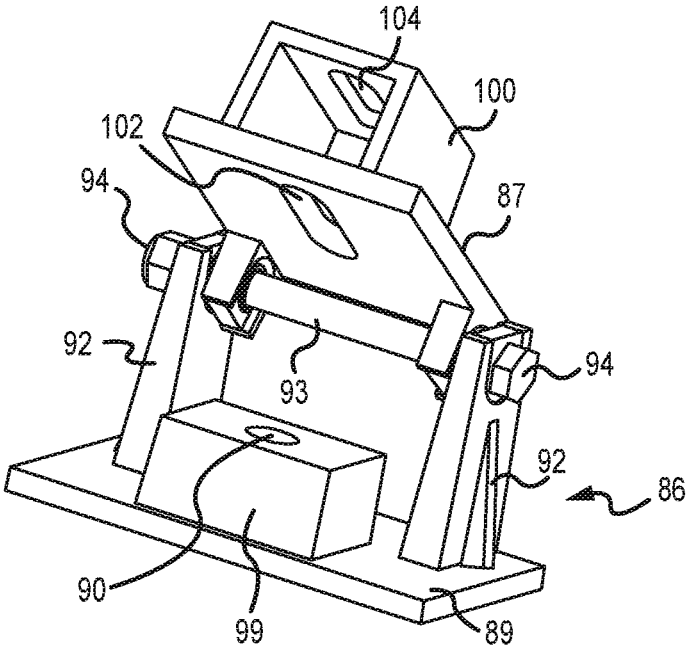

FIG. 19 is an elevation view of the locking lid according to the embodiment of FIG. 19;

FIG. 20 is a bottom perspective view of the locking lid of the embodiment of FIG. 19;

FIG. 21*a* is a perspective view of a component of a locking lid according to one embodiment of the present disclosure; and FIG. 21*b* is a perspective view of a component of a locking lid according to one embodiment of the present disclosure.

DETAILED DESCRIPTION

The present invention provides its benefits across a broad spectrum of endeavors. It is applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention, the invention being measured by the appended claims and not by the details of the specification.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

While various embodiments of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

FIGS. 1-2 depict a lid 2 adapted for use with a subgrade vault (not shown) according to one embodiment of the present disclosure. As shown, the lid 2 is sized to rest upon a shoulder or shelf portion of a cap of the subgrade vault, such that an upper surface of the lid is generally flush with upper portions of the cap when the lid 2 is in a closed position. The lid 2 is provided with at least one aperture, and preferably two apertures 4*a*, 4*b* adapted to align with a portion of locking elements 6*a*, 6*b*, as will be described in greater detail herein. Apertures 4*a*, 4*b* provides access to locking features of the present disclosure, while maintaining a substantially flush or flat upper surface of the lid 2.

In one embodiment, a security frame assembly 8 is provided on an underside or bottom of the lid 2. The security frame assembly 8 is preferably a substantially rigid steel frame structure which may be retrofitted to existing lids by standard connections, such as known fasteners 10.

Various embodiments of the present disclosure contemplate the use of tamper-proof or tamper-resistant fasteners, such that when a lid 2 is applied to a cap 12 and a fastener is employed to secure the lid 2, contents housed within a subgrade vault are generally inaccessible to those lacking the proper means (e.g. specialty tools). In various embodiments, selectively removable caps or covers are provided to protect fasteners from the elements, render them less obvious to potential trespassers, and/or create a more uniform and aesthetically pleasing upper portion of the lid 2.

As shown in FIG. 3*a*, a utility vault 14 comprises an internal storage volume defined by internal walls of the vault 14. An upper portion 16 of the vault is provided with an inward taper or angle such that an internal perimeter of the vault 14 at one vertical location is less than an internal perimeter of the vault 14 at a lower vertical location. Tapered portion 16 provides a locking surface for contact with additional lid features as shown and described herein.

Referring now to FIG. 3*b*, detail A of FIG. 3*a* is provided. As shown, the lid 2 is provided in a closed or locked position. Locking element 6*b* is oriented such that an interference fit is provided between the locking element 6*b* and a tapered portion 16 of the vault 14. The locking element 6*b* is selectively adjustable from an above-ground location to selectively position the locking element 6*b* between at least one locked and at least one unlocked position. The unlocked position of locking element 6*b* is depicted in FIGS. 4*a*-4*b*.

In the embodiment depicted in FIGS. 3*a*-4*b*, the locking element 6*b* comprises a threaded member and an at least partially restrained nut. Referring now to FIGS. 5*a*-5*b*, the locking elements 6*a*, 6*b* are shown in more detail. FIGS. 5*a*-5*b* show the elements 6*a*, 6*b* in an open position. The locking elements 6 comprise a flange member 18 for contacting a nut 22 disposed on a vertically oriented threaded member 26. A biasing element 20, such as a coil spring is provided in combination with the threaded member 26. For illustration purposes, a line 24 is provided to indicate a vertical plane. When locking members 6 are disposed in the open or lowered position of FIGS. 5*a* and 5*b*, the lid 2 may be lifted vertically upward and the locking elements pass through an upper opening or aperture of the vault. When the locking elements 6 are raised and thus rotated outwardly, at least a portion of the locking element(s) will extend beyond the boundary line 24 to a position where contact is made between the locking element 6 and the tapered portion(s) 16 of the vault, thus prohibiting removal of the lid.

In order to effect rotation of the locking elements 6 about hinges 28, a rotational force is imparted upon an upper portion of the threaded member 26, the upper portion being disposed above or within a thickness of the lid 2. The rotational force applied to the threaded member 26 further applies a rotational force upon the nut 22. However, rotational force upon the nut 22 is resisted and rotation of the nut 22 is substantially prevented by contact between the nut 22 and the flange 18. This resistance and prohibition on movement causes the nut 22 to translate along the length of the threaded member 26. As will be recognized by one of skill in the art, the direction of travel of the nut 22 will be dictated by the threading of the member 26 and the direction of rotation applied to the threaded member 26. Thus, when the appropriate rotation is applied to threaded member 26, a rotational force is applied to corresponding nut 22, whereupon rotation of the nut 22 is prevented by contact with flange 18 and the nut 22 translates upwardly, thus drawing locking element 6*b* to a closed position, the closed position characterized by at least a portion of the locking element 6*b* extending beyond boundary line 24.

The closed position of locking features 6*a*, 6*b* is shown in FIG. 6. As shown, the locking elements 6*a*, 6*b* are both drawn upwardly such that a portion of the substantially rigid locking element 6*a*, 6*b* contacts the tapered portion 16 of the vault 14. FIG. 6 depicts the springs 20 provided around the threaded member 26 in a compressed state. Springs 20 provide the necessary force to allow the locking elements 6*a*, 6*b* to be lowered or transitioned into an unlocked state (See FIG. 5). It will be appreciated that where the appropriate rotation is applied to the threaded member 26 to translate the nut 22 down the length of the threaded member 26, the nut 22 is not capable of rotating the member 6 downwardly. That is, some additional force is required to move the member 6 and prevent the nut 22 from simply extending below the member 6 and flange 18, where the nut 22 would rotate freely. In various embodiments, and as shown in FIGS. 1-6, this force is provided by coil spring 20. Thus, when rotation is applied to the threaded member as depicted in FIG. 6, interaction between the nut 22 and flange 18 with cause the nut to move downward. The rotatable locking member 6 tracks or follows the nut 22 due at least in part to a downward force applied by the coil spring 20. A flange or washer is provided on a lower end of the threaded member 26 in various embodiments to prevent the nut 22 from becoming detached from the threaded member 26.

FIGS. 7-8 are top and bottom perspective views of one embodiment of the present disclosure, respectively. As shown, a locking lid 30 for interconnection with a subgrade vault is provided. In the embodiment shown, two substantially rigid hinged locking arms 32 are provided for securing the lid 30. The hinged locking arms 32 are rotatable about hinges 33, 35 and may be accessed or controlled from a single above-grade or surface level access point 34. Hinged locking arms 32 are provided for communication with at least one internal surface of a corresponding subgrade vault. The locking arms 32 are rotatable between at least one open or unlocked position and at least one closed or locked position.

FIGS. 9*a*-9*b* depict a partial cut-away perspective view of the embodiment of FIGS. 7-8. The lid 30 and associated locking arms 32 are shown in connection with a cap 36 and subgrade vault structure 38. Although subgrade vault structures are generally depicted as comprising rectangular cubes, it will be expressly recognized that the present disclosure is not so limited. Indeed, vaults of various sizes, dimensions, and proportions are contemplated as within the scope and spirit of the present disclosure. Locking arms 32 are each rotatable about at least one hinge 35, and preferably two hinges, such that they are selectively positionable between an open position and a closed or locked position.

Referring now to FIG. 11*a*-11*b*, locking arms 32*a*, 32*b* are shown in an open position. Each locking arm is provided with two hinges 42*a*, 44*a*, 42*b*, 44*b*. A substantially vertically oriented threaded member 46 is provided. Hinge members 44*a*, 44*b* are both hingedly connected to a translatable member 48 on the threaded member 46. In one embodiment, translatable member 48 comprises a flanged nut or similar threaded member. The rotation of the translatable member 48 is opposed (e.g. by interconnection to non-rotatable elements) such that rotation of the threaded member 46 produces linear movement of the nut 48 along the threaded member 46. Based on the hinged connections 42*a*, 44*a*, 42*b*, 44*b*, distal ends 40 are angularly displaced when the nut 48 is translated. Thus, translation of the translatable member 48 causes movement of the ends 40 of the locking arms 32 between at least a locked and an unlocked position.

FIG. 11*b* depicts a distal end 40 of a locking arm disposed in an open position. As shown, an approximately 3/16-inch clearance is provided between the narrowest portion of the vault 38 and the end of the locking arm 40. Various embodiments contemplate various gaps or spacing between locking elements and side walls of the vault. Various embodiments contemplate, for example, providing gaps between approximately 1/16 inches and 1 inch for an open position. Preferably, however, a sufficient tolerance is provided between locking elements and vault portions to accommodate for natural size changes of various components (e.g. due to thermal expansions/contractions, shifting of ground features and devices, etc.). Thus, preferred embodiments comprise gaps or tolerances of between approximately 3/16 inches and ½ inches.

FIG. 12 depicts a closed position of the locking arms 32*a*, 32*b* wherein the distal ends 40 of the locking arms are rotated or otherwise repositioned into a position of engagement with the interior of the vault. Vertical displacement (i.e. removal) of the lid 30 is thus prevented. As shown, the translatable member 48 has been lowered (with respect to FIG. 11*a*) such that the arms 32*a*, 32*b* have been rotated about pivot points 42*a*, 44*a*, 42*b*, 44*b* and the distal ends 40 brought into contact with the interior surfaces of the vault.

FIGS. 13*a* and 13*b* provide top and bottom perspective views of a lid according one embodiment of the present disclosure, respectively. As shown, a lid 50 comprises one or more apertures 52, which are selectively sealable by cap or plug member 54. Rotating locking arms 56*a*, 56*b* are provided on an underside of the lid 50. For each locking arm 56, a bracket 58 is provided, the bracket 58 being secured to the underside of the lid. The bracket 58 comprises a substantially rigid structure and receives the locking arm 56 in a rotatable manner about hinge point 60. The locking arm 56 is rotatably secured to the bracket 60 through any one of a variety of known means and devices, including, but not limited to, nut and bolt connections.

A control member 62 is provided which extends through a slot 61 in the locking arm 56. The control member 62 is contemplated as comprising, but is not limited to, a threaded rotatable member. The control member 62 of certain embodiments comprises a threaded member such as a bolt with a nut and wherein the rotation of the nut is opposed so as to facilitate translation of the nut along the length of the bolt. In alternative embodiments, the control member 62 comprises a worm gear for inducing rotational movement directly to a locking member 56. A top portion of the control member 62 is accessible from the aperture 52 provided in the top surface of the lid 50. When the control member 62 is rotated, a nut 64 is translated along the length of the control member 62 due in part to the nut being provided in a substantially fixed rotational position. Rotation of the nut 64 is at least partially restricted from rotation by contact with at least one flange member 65. Where rotation of the control member 62 is effected, yet rotation of the nut 64 is restricted, it will be recognized that the nut 64 will travel or creep along the length of the control member 64, similar to the features and functions described herein with respect to FIGS. 1-6. Such travel causes the locking arm 56 to rotate between a locked and an unlocked position by pivoting about hinge 60. The locked position is generally defined or characterized by the locking arm 56 being in a raised position such that a distal end of the locking arm contacts a sidewall of the vault and thus prevents removal of the associated lid. The unlocked position is generally defined or characterized by the locking arm 56 being in a lowered position such that a distal end of the locking arm is rotated away from a point of contact with the vault (i.e. either up or down) such that the lid may be removed without contact or interference between the arm 56 and an internal portion of the vault.

In certain embodiments, the locking arms 56 are provided with biasing members to bias the locking arms toward an open position. In one embodiment, at least one of the locking arms 56 is provided with a coil spring provided substantially coaxial with the control member 62. The coil spring serves to bias the locking arm 56 toward an open position such that when the nut 64 is rotated, rotation of the locking arm is facilitated. This may be particularly advantageous, for example, where the locking arm 56 has been brought securely into contact with a sidewall of the vault and the force of gravity alone is not sufficient to subsequently lower the locking arm 56. In another embodiment, a torsion spring is provided proximal a hinge point 60 of the locking 56 to bias the locking arm 56 toward an open position. For example, the torsion spring may be provided around a bolt 60 that defines the hinge point, with a portion of the torsion spring applying a downward force on an upper surface of the locking arm 56 and thereby biasing the locking arm 56 toward an open or unlocked position. In embodiments that comprise one or more biasing elements, it is contemplated that the biasing elements do not comprise sufficient force to move the nut 64 downwardly in the absence of additional input. That is, downward movement of the nut 64 requires rotation of the control member 62 wherein corresponding rotation of the nut 64 is opposed by a flange member 65. Downward movement or creep of the nut 64 is therefore induced and a corresponding downward movement of the locking arm 56 is facilitated by the biasing force provided by the biasing member.

In one embodiment, a coil spring is provided along a length of the threaded member to assist in downward movement of the locking arm 56 (see, e.g. FIG. 5*a*). Alternatively, one or more springs are provided at or proximal to the hinge point 60. For example, in one embodiment, a torsion spring is provided in the hinge point 60 to bias the locking arm 56 toward a lowered position. In various embodiments, threaded members of the present disclosure are provided in slots of the locking arm or feature to allow for rotation of the locking feature while the threaded member remains is a substantially fixed lateral position.

FIGS. 14*a*-14*c* provide bottom plan, side elevation, and cross-sectional views of the lid 50. The underside of the depicted lid 60 comprises two locking arms 56*a*, 56*b*, although alternative embodiments contemplate any number of locking arms, including a single locking arm and three or more locking arms. A slot 61 is provided in the rotatable locking arms 56*a*, 56*b* to allow for rotation about bolt 60 without interference from vertically disposed control member 62.

FIG. 14*b* is a cross-sectional view taken at section A-A of FIG. 14*a*. As shown, a pair of locking arms 56*a*, 56*b* are provided on corresponding brackets 58 and rotatable about a bolt 60 joining the respective arm 56 with the bracket 58. Control members 62 are provided and extend downwardly from a bottom surface of the lid 50. The control members 62 extend through slots in the locking members 56 and comprise a translatable member 64 for interaction with the locking member 56. Rotation of the translatable member 64, which preferably comprises a nut, is opposed by contact with a flange member 65 such that when rotation of the control member 62 is effected, this rotation induces a translational movement of the translatable member 64 along a length of the threaded member rather than a rotational movement about the axis of the control member 62. An upward (downward in FIG. 14*b*) movement of the translatable member 64 provides force to the locking member 56 and moves the locking member 56 into a locked position as shown and described herein. Rotational movement of the control member 62 may be accomplished by applying force to a head 69 of the control member 62, the head 69 being accessible through an aperture provided in an upper surface of the lid 50.

FIG. 14*c* is a side elevation view of the lid 50 of FIGS. 14*a*-14*b*. As shown, the bolt 60 which connects the locking member 56 to the bracket 58 and defines an axis of rotation of the locking arm 56 comprises a torsion spring 70. The torsion spring 70 comprises an extension for applying force to the locking member 56 and facilitating an unlocking operation of the locking member 56. One of skill in the art will recognize that as a control member 62 is rotated and the opposed nut 64 is translated along a length of the control member 62, the nut 64 serves to raise the locking member 56. When the nut is lowered through reverse rotation, however, it will be recognized that the locking member 56 may require some additional input or force to follow the nut 64 downwardly, particularly where the locking member 56 has been brought into contact with an internal side portion of a vault. The spring 70 provides this additional biasing force. The spring force of the spring 70 is not of sufficient magnitude, however, to move or translate the nut by itself. Rather, the spring 70 cooperates with a rotational movement of the control member 62 to lower the locking member 56. In various embodiments a washer or limiter 67 is provided at a distal end of the control member 62 to prevent the nut 64 from being inadvertently translated off of the control member 62.

FIG. 15*a* is a perspective view of a locking lid 80 according to one embodiment of the present disclosure. As shown, the lid comprises a substantially rectangular lid with an upper surface 82. The upper surface 82 is adapted to and intended to be provided proximal to and/or flush with a ground surface. As with other embodiments shown and described herein, the lid 80 is operable to selectively close and secure an interior volume comprising an enclosure for utility connections (for example). It is an object of embodiments of the present disclosure to provide an enclosed space that is selectively accessible to authorized or qualified personnel, while limiting access to others. Accordingly, the embodiment of FIG. 15*a* comprises locking means to secure the lid 80 to an enclosure. Specifically, and as shown in FIG. 15*a*, the lid 80 comprises first and second locking elements 86*a*, 86*b* that comprise rotatable wings or arms. The locking elements 86*a*, 86*b* are rotatable about an axis, and are rotatable between a locked position and an unlocked position. Although not shown in FIGS. 15*a*-15*b*, various embodiments of the present disclosure contemplate that at least one threaded member is provided with the lid 80, wherein the threaded member extends through an aperture 90*a*, 90*b* in the lid and wherein a portion of the threaded member (e.g. a head of the threaded member) is accessible from an upper side of the lid 80. The threaded member is in communication with at least one of the locking elements 86*a*, 86*b* as shown and described herein. The lid 80 comprises a sidewall 84 extending around a perimeter of the lid 80. In various embodiments, the sidewall 84 is adapted to nest within a portion of a cap of an enclosure or vault system.

FIG. 15*b* is a bottom perspective view of the lid 80 shown in FIG. 15*a*. As provided in FIG. 15*b*, first and second locking elements 86*a*, 86*b* are provided. The locking elements 86*a*, 86*b* are rotatably attached to extensions 92*a*, 92*b* which preferably extend from a lower surface 88 of the lid 80. In the depicted embodiment, the extensions 92*a*, 92*b* extend substantially perpendicularly from the lower surface 88. It will be recognized, however, that the present disclosure is not limited to such embodiments, and various alternatives to the extensions shown in FIG. 15*b* are contemplated. In certain embodiments, the extensions 92 and at least a lower portion of the lid 80 are formed of a single piece of material. For example, the lower portion 88 of the lid 80 and the extensions 92 may be cast or molded as a single piece. The locking elements 86*a*, 86*b* are rotatably connected to the extensions by fasteners 94*a*, 94*b*, such as a bolt or pin. The locking elements 86*a*, 86*b* are thus rotatable about an axis that generally corresponds to a longitudinal axis of the fasteners(s) 94. The locking elements 86*a*, 86*b* comprise a substantially planar portion 87 with a cage 100 extending from the substantially planar portion 87. The cage 100 comprises an elongate slot 99 through which the threaded fastener extends. The elongate nature of the slot 99 allow for a rotation of the locking element 86, even when a threaded fastener is provided through the locking element 86.

FIG. 16 is a bottom perspective view of the lid 80 according to the embodiments of FIGS. 15*a* and 15*b*. For illustration purposes, the lid 80 in FIG. 16 is shown without the locking members 86*a*, 86*b*. As shown in FIG. 16, the lid 80 comprises a plurality of extensions 92 for receiving locking elements. Apertures 90*a*, 90*b* extend through the lid from an upper surface of the lid (see FIG. 15*a*). The apertures are provided through a protrusion 99. The protrusions 99 and extensions 92 are preferably formed with a bottom surface of the lid 80 as a single element. For example, the lid 80, the extensions 92 and the protrusions 99 are contemplated as being cast as a single piece of iron or molded as a single pieced of plastic. In alternative embodiments, the extensions 92 and/or protrusions 99 may be provided as attachment members that are secured (e.g. welded) to the lid 80.

FIGS. 17-18 are perspective views of a locking element 86 according to one embodiment of the present disclosure. As shown in FIGS. 17-18, the locking element 86 comprises a rotatable locking feature for securing at least a portion of a lid (not shown in FIG. 17) to a cap or another portion of a vault. Accordingly, the locking element 86 preferably comprises a rigid material including, but not limited to, a ferrous material. The locking element 86 comprises a substantially planar portion 87 with a cage extending therefrom. The cage 100 comprises an elongate aperture 104. The substantially planar portion 87 also comprises an elongate aperture 102. Both elongate apertures 102, 104 are provided to enable or allow a rotation of the locking element 86 when a fastener (e.g. threaded bolt) is provided and extends through the cage 100. The locking element 86 further comprises first and second extensions 95 that extend from the substantially planar portion 87. Preferably, the first and second extensions 95 extend from the substantially planar portion on an opposite side of the substantially planar portion from the cage 100. The extensions 95 comprise apertures 96 for receiving a bolt or similar fastener and for securing the locking element 86 to a lid such that the locking element 86 is rotatable and as shown and described herein.

FIG. 19 is a front elevation view of a locking lid assembly according to one embodiment of the present disclosure. As shown, the lid 80 comprises an upper surface 82 and a sidewall 84. Preferably, the upper surface 82 extends beyond the sidewall 84 and provides a lip 106 or overhang that is adapted to rest on and be positioned on a cap of an enclosure or vault, for example. The lid assembly further comprises first and second locking elements 86*a*, 86*b* that are selectively rotatable. The locking elements 86 are rotatable about an axis that corresponds to a longitudinal axis of a fastener 94*a*, 94*b* provided through a bracket or other extension 114*a*, 114*b*, respectively. The upper surface of the lid comprises apertures 90*a*, 90*b* or similar access points through which fasteners are provided. Preferably, the fasteners extend downwardly through the lid and through the locking elements 86. Manipulation and manual rotation of the fasteners is operable to provide a force to rotate the locking elements 86 as shown and described herein.

As shown in FIGS. 19-20, distal ends of the fasteners are provided with a secure or fixed nut 112*a*, 112*b*. The fixed nuts 112*a*, 112*b* are provided to prevent the locking elements 86 from rotating off of or below the fastener(s). In order to effectuate a rotation of the locking element 86 about a horizontal axis generally corresponding to a longitudinal axis of the fastener(s) 94*a*, 94*b*, a moveable nut 115 is provided within each cage 100 of each locking element 86. When the fastener 120 is rotated, a corresponding rotation of the moveable nut 115 that would otherwise occur is opposed by sidewalls of the cage(s) 100. The opposition of rotation of the moveable nut(s) 115 results in a movement of the nut 115 along a length of the fastener 120, wherein the direction of linear movement of the moveable nut 115 depends upon a direction of rotation of the fastener 120. The linear movement of the moveable nut 115 serves to pull a locking member 86 upwardly or push the locking member 86 downwardly. The locking members 86 are thus rotatable between a lowered position corresponding to an unlocked position of the lid, and a raised position corresponding to a locked position of the lid wherein the locking element 86 is in contact with a sidewall of a vault (for example). In the embodiment of FIG. 19, springs 110*a*, 110*b* are provided on each of the fasteners 120. The springs 110*a*, 110*b*, which are provided in the form of a coil spring in the embodiment of FIG. 19, serve to bias the locking element 86 downwardly (at least with respect to the orientation shown in FIG. 19). The spring(s) 110 are operable to prevent the locking elements from getting caught or stuck in a raised or locked position.

FIG. 20 is a bottom perspective view of the lid 80 of FIG. 19. As shown, the lid 80 comprises a pair or locking elements 86*a*, 86*b* that are rotatable interconnected to bracket members 114*a*, 114*b*. As shown in FIG. 20, fasteners extend through an upper portion of the lid 80 and through a fastener 90 and at least a portion of the locking element 86.

FIGS. 21*a*-21*b* are perspective views of a locking element and related hardware according to one embodiment of the present disclosure. The locking elements of FIGS. 21*a*-21*b* are shown in isolation for illustrative purposes. The elements may be but are not necessarily formed or provided as individual or separable components from a lid. As shown, the locking element 86 is rotatable attached to a base portion 89 with extensions 92. The locking element 86 is rotatable with respect to the base 88 and lid (not shown) about a bolt 94 or similar fastener. Apertures 90 extend through a lid and through a protrusion 99. The aperture 90 is adapted to receiving a threaded fastener, which also preferably extends through elongate slots 102, 104 provided in the locking element.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure.

Moreover, though the present disclosure has included description of one or more embodiments and certain variations and modifications, other variations and modifications are within the scope of the disclosure, e.g. the use of a certain component described above alone or in conjunction with other components may comprise a system, while in other aspects the system may be the combination of all of the components described herein, and in different order than that employed for the purpose of communicating the novel aspects of the present disclosure. Other variations and modifications may be within the skill and knowledge of those in the art, after understanding the present disclosure. This method of disclosure is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A subgrade vault, comprising:

a body portion comprising four side walls which define an enclosure, an upper end, and a lower end;

at least one of the four sidewalls comprising an inward taper such that the vault comprises a first internal perimeter proximal the upper end and a second internal perimeter proximal the lower end, the first internal perimeter being less than the second internal perimeter;

a lid comprising a top surface and a bottom surface and the bottom surface comprising at least one rotatable locking element that is rotatable between a first position and a second position, the first position comprising an unlocked position and the second position comprising a locked position wherein the at least one rotatable locking element is provided in contact with at least one of the four side walls of the body portion;

a threaded fastener extending through at least a portion of the lid and at least a portion of the at least one rotatable locking element;

the at least one rotatable locking element comprising an elongate ovoid slot, and wherein the threaded fastener extends through the elongate ovoid slot and the elongate ovoid slot enables movement of the at least one locking element; and a biasing member in the form of a coil spring that biases the at least one rotatable locking element such that rotation of the substantially rigid locking arm is facilitated; and wherein the at least one rotatable locking element comprises a nut at least partially contained within a portion of the at least one rotatable locking element, and wherein a rotation of the nut is opposed by the at least one rotatable locking element.

2. The subgrade vault of claim 1, further comprising a cap member operably interconnected to the upper end of at least one of the four side walls.

3. The subgrade vault of claim 1, wherein a first end of the threaded fastener is accessible from the top surface of said lid, and wherein rotation of said threaded fastener results in rotation of said at least one rotatable locking element between said first position and said second position.

4. The subgrade vault of claim 1, wherein said biasing member comprises a coil spring provided substantially coaxial with the threaded fastener.

5. The subgrade vault of claim 3, wherein the threaded fastener comprises a second nut that is secured to a distal end of the threaded fastener.

6. The subgrade vault of claim 5, further comprising a washer fixed at the distal end of the of the threaded fastener.

7. The subgrade vault of claim 3, wherein the lid comprises at least one aperture for accessing the first end of the threaded fastener.

8. A lid adapted for locking engagement with a subgrade vault, said lid comprising:

an upper surface oriented in a substantially horizontal plane, a lower surface, a predetermined length, a width, and a height;

a locking member for releasably securing said lid to said subgrade vault, said locking member being rotatable with respect to said lid and provided on the lower surface of the lid;

said locking member having a predetermined length and being rotatable between at least a first unlocked position and a second locked position, said second locked position characterized by a distal end of the locking member being in force transmitting communication with an interior surface of said vault; and a control member comprising a proximal end and a distal end, said proximal end being accessible from the upper surface of said lid and the control member is adapted for rotating said locking member between said first position and said second position;

wherein a nut is provided on the control member, and the nut is at least partially disposed within the locking member such that rotation of the nut is opposed by the locking member;

the locking member comprising a planar portion with an elongate slot provided therein, and wherein the control member extends through the elongate slot; and a coil spring provided substantially coaxial with the control member and substantially perpendicular to said lower surface of said lid, the coil spring providing a downward force to the locking member.

9. The lid of claim 8, wherein activation of said control member results in rotation of said locking member between said first position and said second position.

10. The lid vault of claim 8, wherein the planar portion of the locking member comprises a cage extending therefrom, and wherein the nut is provided within the cage.

11. The subgrade vault of claim 8, wherein the coil spring is compressed when the locking member is in a locked position.

12. The subgrade vault of claim 8, wherein the control member comprises a threaded bolt and wherein the nut is provided on and moveable along an axis of the threaded member.

13. The subgrade vault of claim 12, further comprising a washer fixed at a second end of the threaded member.

14. The subgrade vault of claim 8, wherein the lid comprises at least one aperture for accessing the first end of the control member.

15. A subgrade vault assembly for providing an enclosed region to secure utility connections, said assembly comprising:

a lid comprising an upper surface oriented in a substantially horizontal plane, a lower surface, a length, a width, and a height;

a rotatable locking member positioned proximate to said lower surface of the lid and having a predetermined length and rotatable between at least a first unlocked position and a second locked position;

said rotatable locking member interconnected to a bracket, said bracket secured to said lower surface of said lid, and said rotatable locking member comprising an elongate slot;

a bolt extending through at least a portion of the lid and through the elongate slot, and a nut adapted for contacting a cage member of the rotatable locking member and effecting a movement of the rotatable locking member;

a coil spring provided substantially coaxially with the bolt and providing a force on the rotatable locking member, the force comprising a downward force, and wherein the coil spring is provided in a compressed state when the rotatable locking element is provided in a locked position;

a vault having a body portion comprising four side walls which define an enclosure, an upper end, and lower end, and at least one of the four sidewalls comprising an inward taper such that the vault comprises a first internal perimeter proximal the upper end and a second internal perimeter proximal the lower end, the first internal perimeter being less than the second internal perimeter;

said rotatable locking member being rotatable between the first unlocked position and the second locked position, said second locked position characterized by a portion of the rotatable locking member being in force transmitting communication with an interior surface of a sidewall of said vault such that said lid and said vault are securely interconnected when said rotatable locking member is provided in said second position.

16. The subgrade vault of claim 15, wherein a first end of the bolt is accessible from the top surface of said lid, and wherein rotation of said bolt results in rotation of said locking member between said first unlocked position and said second locked position.

17. The subgrade vault of claim 15, wherein said coil spring biases the locking member toward the first unlocked position.

18. The subgrade vault of claim 15, wherein rotation of the nut is opposed such that rotation of the threaded member induces a movement of the nut along an axis of the threaded member to engage the rotatable locking member.

19. The subgrade vault of claim 15, wherein the lid comprises at least one aperture for accessing the first end of the threaded member such that rotation of the locking member may be effected from an exterior of the vault.

20. The subgrade vault of claim 15, wherein the vault is comprised of at least one of a precast concrete material, a fiberglass, a plastic material, and a cement material.

* * * * *